US009046070B2

(12) United States Patent
Okada et al.

(10) Patent No.: US 9,046,070 B2
(45) Date of Patent: Jun. 2, 2015

(54) STARTING CONTROL UNIT AND START COMMAND SIGNAL GENERATION APPARATUS THEREFOR

(75) Inventors: Tadaaki Okada, Osaka (JP); Haruki Nakayama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1120 days.

(21) Appl. No.: 13/044,264

(22) Filed: Mar. 9, 2011

(65) Prior Publication Data

US 2012/0060786 A1 Mar. 15, 2012

(30) Foreign Application Priority Data

Sep. 13, 2010 (JP) ..... 2010-204337

(51) Int. Cl.

| | |
|---|---|
| ***F02N 11/00*** | (2006.01) |
| ***F02N 11/08*** | (2006.01) |
| ***F02N 11/10*** | (2006.01) |
| *F02P 11/00* | (2006.01) |

(52) U.S. Cl.

CPC ..... *F02N 11/087* (2013.01); *F02D 2200/0404* (2013.01); *F02N 11/0862* (2013.01); *F02N 11/10* (2013.01); *F02N 2200/101* (2013.01); *F02P 11/00* (2013.01)

(58) Field of Classification Search

CPC ... F02N 11/10; F02N 11/087; F02N 11/0862; F02N 11/08; F02N 11/00

USPC ..... 290/38 R, 48

See application file for complete search history.

(56) References Cited

U.S. PATENT DOCUMENTS

| | | | | |
|---|---|---|---|---|
| 4,406,951 | A * | 9/1983 | Inoue | 307/10.1 |
| 5,967,106 | A * | 10/1999 | Schulze et al. | 123/179.3 |
| 6,050,233 | A * | 4/2000 | Vilou | 123/179.3 |
| 6,104,157 | A * | 8/2000 | Kramer et al. | 318/445 |
| 8,492,916 | B2 * | 7/2013 | Murata et al. | 290/38 R |
| 2009/0278509 | A1 * | 11/2009 | Boyles et al. | 320/163 |

(Continued)

FOREIGN PATENT DOCUMENTS

| | | | |
|---|---|---|---|
| JP | 59-30564 | U | 2/1984 |
| JP | 2005-16388 | A | 1/2005 |

(Continued)

*Primary Examiner* — Pedro J Cuevas
*Assistant Examiner* — Viet Nguyen
(74) *Attorney, Agent, or Firm* — Sughrue Mion, PLLC; Richard C. Turner

(57) ABSTRACT

A starting control unit integrally includes a current suppression resistor connected in series with an output contact of an electromagnetic shift relay provided on a starter motor, a short-circuiting relay that short-circuits the current suppression resistor with a short-circuiting contact thereof, and a timer circuit that closes the short-circuiting contact at a predetermined time instant when a starting current decreases in response to the operation of a starting command switch. An excitation coil of the short-circuiting relay is supplied with electric power directly from a vehicle battery by way of one of the terminals of the current suppression resistor, a reverse connection protection device, and a driving transistor, excluding the starting command switch. A suppression starting current for the starter motor flows in the current suppression resistor during the time period obtained by adding a delay setting time T0 of the timer circuit and a t2*b* from a time instant when the excitation coil is de-energized to a time instant when the short-circuiting contact is returned to be closed.

7 Claims, 18 Drawing Sheets

(56) References Cited

U.S. PATENT DOCUMENTS

| | | | | |
|---|---|---|---|---|
| 2011/0095545 | A1* | 4/2011 | Nakayama et al. | 290/38 R |
| 2011/0196570 | A1* | 8/2011 | Nakamura | 701/29 |
| 2012/0200093 | A1* | 8/2012 | Venkatasubramaniam et al. | 290/38 R |
| 2012/0275078 | A1* | 11/2012 | Kokubun et al. | 361/160 |
| 2014/0035292 | A1* | 2/2014 | Gronwald | 290/38 R |

FOREIGN PATENT DOCUMENTS

| | | | |
|---|---|---|---|
| JP | 2009-191843 | A | 8/2009 |
| JP | 2009-287459 | A | 12/2009 |
| JP | 2010-242557 | A | 10/2010 |

* cited by examiner

● WHEN VOLTAGE IS LIMITED $I = (Vb - Vc)/R1$ $W = Vb \times I = Vb \times (Vb - Vc)/R1$ $Vc \leqq Vb \times R2/(R1 + R2)$

● WHEN VOLTAGE IS LOW $Vb \times R2/(R1 + R2) \leqq Vc$ $W = Vb^2/(R1 + R2)$

T0 DELAY SETTING TIME
T1 CLOSED-CIRCUIT RESPONSE TIME OF ELECTROMAGNETIC SHIFT RELAY (1ST CLOSED-CIRCUIT RESPONSE TIME)
T2b OPEN-CIRCUIT RESPONSE TIME OF NORMALLY CLOSED SHORT-CIRCUITING RELAY
t1 OPEN-CIRCUIT RESPONSE TIME OF ELECTROMAGNETIC SHIFT RELAY
t2b CLOSED-CIRCUIT RESPONSE TIME OF NORMALLY CLOSED SHORT-CIRCUITING RELAY

T0 DELAY SETTING TIME
T1 CLOSED-CIRCUIT RESPONSE TIME OF ELECTROMAGNETIC SHIFT RELAY (1ST CLOSED-CIRCUIT RESPONSE TIME)
T2b OPEN-CIRCUIT RESPONSE TIME OF NORMALLY CLOSED SHORT-CIRCUITING RELAY
t1 OPEN-CIRCUIT RESPONSE TIME OF ELECTROMAGNETIC SHIFT RELAY
t2b CLOSED-CIRCUIT RESPONSE TIME OF NORMALLY CLOSED SHORT-CIRCUITING RELAY

T0 DELAY SETTING TIME

T1 CLOSED-CIRCUIT RESPONSE TIME OF ELECTROMAGNETIC SHIFT RELAY (1ST CLOSED-CIRCUIT RESPONSE TIME)

T2a CLOSED-CIRCUIT RESPONSE TIME OF NORMALLY OPENED SHORT-CIRCUITING RELAY (2ND CLOSED-CIRCUIT RESPONSE TIME)

t1 OPEN-CIRCUIT RESPONSE TIME OF ELECTROMAGNETIC SHIFT RELAY t2a OPEN-CIRCUIT RESPONSE TIME OF NORMALLY OPENED SHORT-CIRCUITING RELAY

FIG. 15

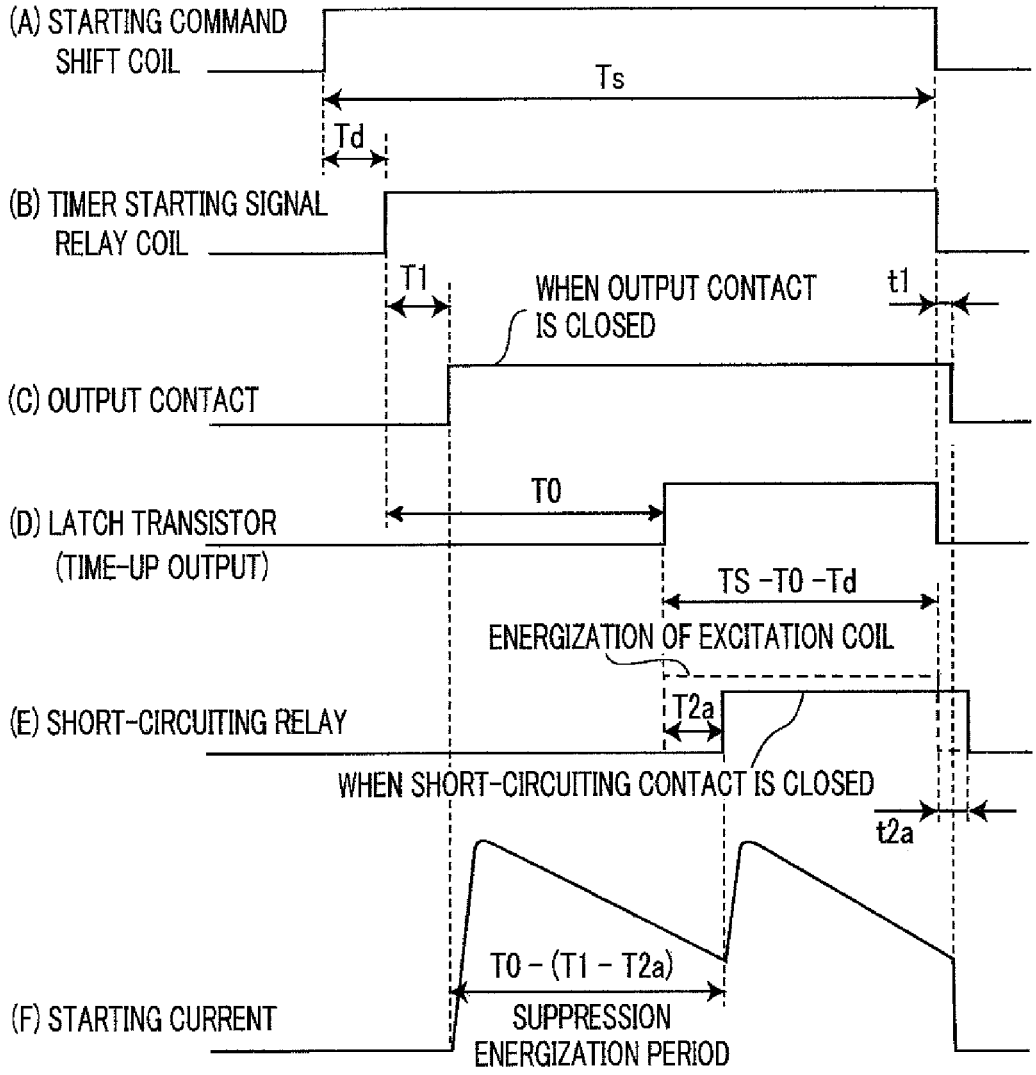

Td DELAY TIME (DELAYED TIMER CIRCUIT UNIT)
T0 DELAY SETTING TIME (STARTING TIMER CIRCUIT UNIT )
T1 CLOSED-CIRCUIT RESPONSE TIME OF ELECTROMAGNETIC SHIFT RELAY (1ST CLOSED-CIRCUIT RESPONSE TIME)
T2a CLOSED-CIRCUIT RESPONSE TIME OF NORMALLY OPENED SHORT-CIRCUITING RELAY (2ND CLOSED-CIRCUIT RESPONSE TIME)
t1 OPEN-CIRCUIT RESPONSE TIME OF ELECTROMAGNETIC SHIFT RELAY
t2a OPEN-CIRCUIT RESPONSE TIME OF NORMALLY OPENED SHORT-CIRCUITING RELAY

STARTING CONTROL UNIT AND START COMMAND SIGNAL GENERATION APPARATUS THEREFOR

BACKGROUND OF THE INVENTION

1. Description of the Related Art

The present invention relates to a starting control unit and the start command signal generation apparatus therefor; in the starting control unit, in order to suppress a starting current, electric power is supplied to the starter motor by way of a current suppression resistor for a predetermined time immediately after the engine has been started.

2. Description of the Related Art

There is utilized a timer circuit for current-limiting starting in which, in order to suppress an excessive starting current at a time when the engine is started and an abnormal drop of the power-source voltage caused by the internal resistance of the vehicle battery and the resistance of a wiring lead, the current suppression resistor is connected in series with the starter motor when the engine is started, and at a time that is a predetermined time after the driving current is attenuated as the rotation speed of the starter motor rises, the current suppression resistor is short-circuited by the output contact of a short-circuiting relay. For example, Patent Document 1 discloses an engine starting apparatus incorporating a starter motor, a fixed resistor connected in series with a current path including an electromagnet shift switch that energizes the starter motor, an opening/closing means that performs short-circuiting control of the fixed resistor, and a delayed-activation means that activates the opening/closing means in a delayed manner; the delayed-activation means is formed of a timer circuit that operates after receiving the output voltage of the electromagnet shift switch.

Moreover, Patent Document 2 discloses a starter including an electromagnetic switch that performs opening and closing of a main contact provided in a motor circuit, a current suppression resistor connected in series with the main contact provided in the motor circuit, a short-circuiting relay that is provided in such a way as to be able to short-circuit the current suppression resistor, and a timer circuit that activates the short-circuiting relay in a delayed manner; the timer circuit sets a delay time between a time instant when the electromagnet switch is energized and a time instant when the short-circuiting relay is energized; the delay time is set in such a way that the value of the maximum current that flows in the motor when the short-circuiting relay is energized becomes the same as or smaller than the value of the maximum current that flows in the motor when the electromagnet switch is energized.

Furthermore, Patent Document 3 discloses a starter in which there are separately provided an excitation coil that pushes out a pinion gear toward a ring gear and a switch coil that is energized when a predetermined time elapses after the excitation coil is energized and that performs circuit-closing drive of the main contact of a motor circuit, and after the pinion gear and the ring gear have securely been engaged with each other, the main contact is closed.

Still moreover, according to Patent Document 4, in order to enable the starting of an engine to continue even when the operation of a central processing unit is interrupted due to a voltage drop at a time when the engine is started, a driving circuit makes a starter relay turn on so as to make a starter operate, when a microcomputer of an ECU (engine control apparatus) detects that a starting switch has turned on; the coil of the starter relay is energized also by way of the starting switch and a normally closed relay; and in the ECU, there is provided a circuit that turns off the normally closed relay in response to a signal from the microcomputer. Accordingly, even when the operation of the microcomputer is interrupted by a voltage drop, the starter relay is kept on, as long as the starting switch is on. When determining that the operation of the starter is not necessary, the microcomputer is required only to turn off the normally closed relay.

PRIOR ART REFERENCE

Patent Document

[Patent Document 1] Japanese Utility Model Laid-Open No. 1984-30564 (Claim in Utility Model Registration and FIG. 2)

[Patent Document 2] Japanese Patent Application Laid-Open No. 2009-287459 (ABSTRACT OF THE DISCLOSURE and FIG. 1)

[Patent Document 3] Japanese Patent Application Laid-Open No. 2009-191843 (ABSTRACT OF THE DISCLOSURE, paragraph 0032, and FIGS. 1 and 7)

[Patent Document 4] Japanese Patent Application Laid-Open No. 2005-16388 (ABSTRACT OF THE DISCLOSURE and FIG. 1)

In the engine starting apparatus according to Patent Document 1, the vehicle battery 7 supplies electric power to a short-circuiting relay (corresponding to the relay 14) by way of the output contact of an electromagnetic shift relay (corresponding to the electromagnet shift switch 2); therefore, the starting command switch (corresponding to the key switch 6) is required to drive only the electromagnetic shift relay. Therefore, the engine starting apparatus according to Patent Document 1 has an advantage that the energization current for the short-circuiting relay does not flow into the starting command switch; additionally, the engine starting apparatus according to Patent Document 1 is characterized in such a way that the setting time set by the timer can be stabilized so as to insusceptible to fluctuation in the power-source voltage.

However, there exists a drawback in that a starting current flows in a current suppression resistor (corresponding to the fixed resistor 13) during a period obtained by adding the setting time set by the timer and the closed-circuit drive response delay time of the short-circuiting relay, and the response time of the short-circuiting relay fluctuates in inverse proportion to the power-source voltage, whereby no stable current-limiting starting time can be obtained. The short-circuiting relay is connected between the electromagnetic shift relay and the starter motor and hence the short-circuiting contact and the current suppression resistor are not directly connected in parallel with each other; therefore, there exists a drawback that three high-current terminals are required.

In contrast, the vehicle battery supplies electric power to the electromagnetic shift relay (corresponding to the electromagnetic switch 7) of the starter according to Patent Document 2 by way of the starter relay; the starting command switch (corresponding to the IG switch 26) drives the starter relay, the short-circuiting relay, and the timer circuit. Accordingly, the timer circuit operates when a predetermined time elapses after the starting command switch closes; however, there exists a drawback that, because supply of electric power to the starter motor (corresponding to the motor 2) is started after a delay time obtained by adding the closed-circuit response delay time of the starter relay and the closed-circuit response delay time of the electromagnetic shift relay, the current-limiting starting time becomes unstable due to the fluctuation in the power-source voltage.

In the case where, although required additionally, the starter relay is removed, and the electromagnetic shift relay is driven directly through the starting command switch, the driving current for the short-circuiting relay also flows in the starting command switch; thus, it is required to increase the current capacity of the contact, and there exists a risk that the starting command switch cannot be opened, because the electromagnetic shift relay may erroneously operate.

Furthermore, the starter according to Patent Document 3 has a drawback in that, provided, due to a voltage drop at a time when the engine is started, the ECU, which is an engine control unit, becomes inoperative, the excitation coil and the switch coil cannot be energized.

In the engine starting control apparatus according to Patent Document 4, there is added a normally closed relay in order to enable the starting of the engine to continue even when the operation of the central processing unit is interrupted due to a voltage drop at a time when the engine is started; thus, there is not unified a starting command signal through which a relatively large current flows for driving the electromagnetic shift relay, whereby the engine starting control apparatus has a drawback that it becomes large-size and expensive as a whole.

SUMMARY OF THE INVENTION

The present invention has been implemented in order to solve the foregoing problems; the first objective thereof is to obtain a starting control unit that suppresses a current that flows in the starting command switch and that makes it possible to configure a current-limiting starting circuit that does not require an unnecessary auxiliary electromagnet relay.

The second objective thereof is to obtain a starting control unit that suppresses fluctuation in the current-limiting starting time even when the response time of the related electromagnet relay fluctuates depending on the power-source voltage and that makes it possible to obtain a stable current-limiting starting time.

Moreover, the third objective thereof is to obtain a small-size and inexpensive starting control unit that suppresses the power consumption.

Furthermore, the fourth objective thereof is to obtain a start command signal generation apparatus for the starting control unit.

A starting control unit according to the present invention is connected between a starter motor for starting a vehicle engine and a vehicle battery and performs current-limiting starting of the starter motor; the starting control unit integrally includes a current suppression resistor connected in series with an output contact of an electromagnetic shift relay provided on the starter motor; a short-circuiting relay that short-circuits the current suppression resistor with a short-circuiting contact thereof; and a timer circuit that closes the short-circuiting contact at a predetermined time instant when a starting current decreases in response to the operation of a starting command switch.

The electromagnetic shift relay propels a pinion gear provided on the starter motor, through a shift coil that is supplied with electric power from the vehicle battery by way of the starting command switch, so that a ring gear provided on the crankshaft of an engine and the pinion gear engage with each other; and the electromagnetic shift relay makes the output contact close through the shift coil or a relay coil provided separately from the shift coil.

The short-circuiting contact is a normally closed contact which is opened by energizing an excitation coil of the short-circuiting relay; and the excitation coil is supplied with electric power directly from the vehicle battery by way of one of the terminals of the current suppression resistor, a reverse connection protection device, and a driving transistor, excluding the starting command switch.

The reverse connection protection device is a transistor or a diode that enables power supply to the excitation coil when the vehicle battery is connected with a normal polarity, but prevents the power supply to the excitation coil when the vehicle battery is connected with an abnormal reversed polarity.

The driving transistor is turned on so as to perform open-circuit energization of the short-circuiting relay at the same time when the starting command switch is closed and hence the shift coil or the relay coil is energized; and by the time the output contact is closed, the short-circuiting contact completes its circuit-opening operation.

The timer circuit starts timing operation in response to closing operation by the output contact of the electromagnetic shift relay, and turns off the driving transistor after a predetermined delay setting time elapses; and a suppression starting current for the starter motor flows in the current suppression resistor during a time period obtained by adding the delay setting time of the timer circuit and a closed-circuit response time from a time instant when the excitation coil of the short-circuiting relay is de-energized to a time instant when the short-circuiting contact is returned to be closed.

A starting control unit according to the present invention is provided with the timer circuit that connects the current suppression resistor in series with the starter motor in a predetermined period after the closing operation by the electromagnetic shift relay that operates in response to the operation of the starting command switch is started, and performs current-limiting starting; and the short-circuiting relay, having a normally opened contact, that is energized and controlled by the timer circuit. The short-circuiting relay is supplied with electric power directly from the vehicle battery by way of the reverse connection protection device and the driving transistor, excluding the starting command switch. Accordingly, power-source wiring for the excitation coil of the short-circuiting relay is not required and the energization current for the short-circuiting relay does not flow in the starting command switch; therefore, there is demonstrated an effect that, by suppressing the current capacity of the switch, a small-size and inexpensive starting command switch can be utilized.

The current suppression starting time is determined by the delay setting time of the timer circuit and the closed-circuit restoration delay time of the short-circuiting relay, without undergoing the effect of the operation response time of the electromagnetic shift relay or the open-circuit response time of the short-circuiting relay that varies depending on the value of the power-source voltage; thus, there is demonstrated an effect that the fluctuation in the power-source voltage affects less and hence a stabilized current suppression starting time can be obtained.

The foregoing and other object, features, aspects, and advantages of the present invention will become more apparent from the following detailed description of the present invention when taken in conjunction with the accompanying drawings.

BRIEF DESCRIPTION OF THE DRAWINGS

FIG. 15 is a timing chart for explaining the operation of a starting control unit according to Embodiment 4 of the present invention;

DETAILED DESCRIPTION OF THE PREFERRED EMBODIMENTS

Hereinafter, with reference to the accompanying drawings, there will be explained preferred embodiments of a starting control unit according to the present invention and the start command signal generation apparatus therefor. The present invention is not limited to these embodiments but includes designing modifications that do not deviate from its spirits.

Embodiment 1

Figure 1:
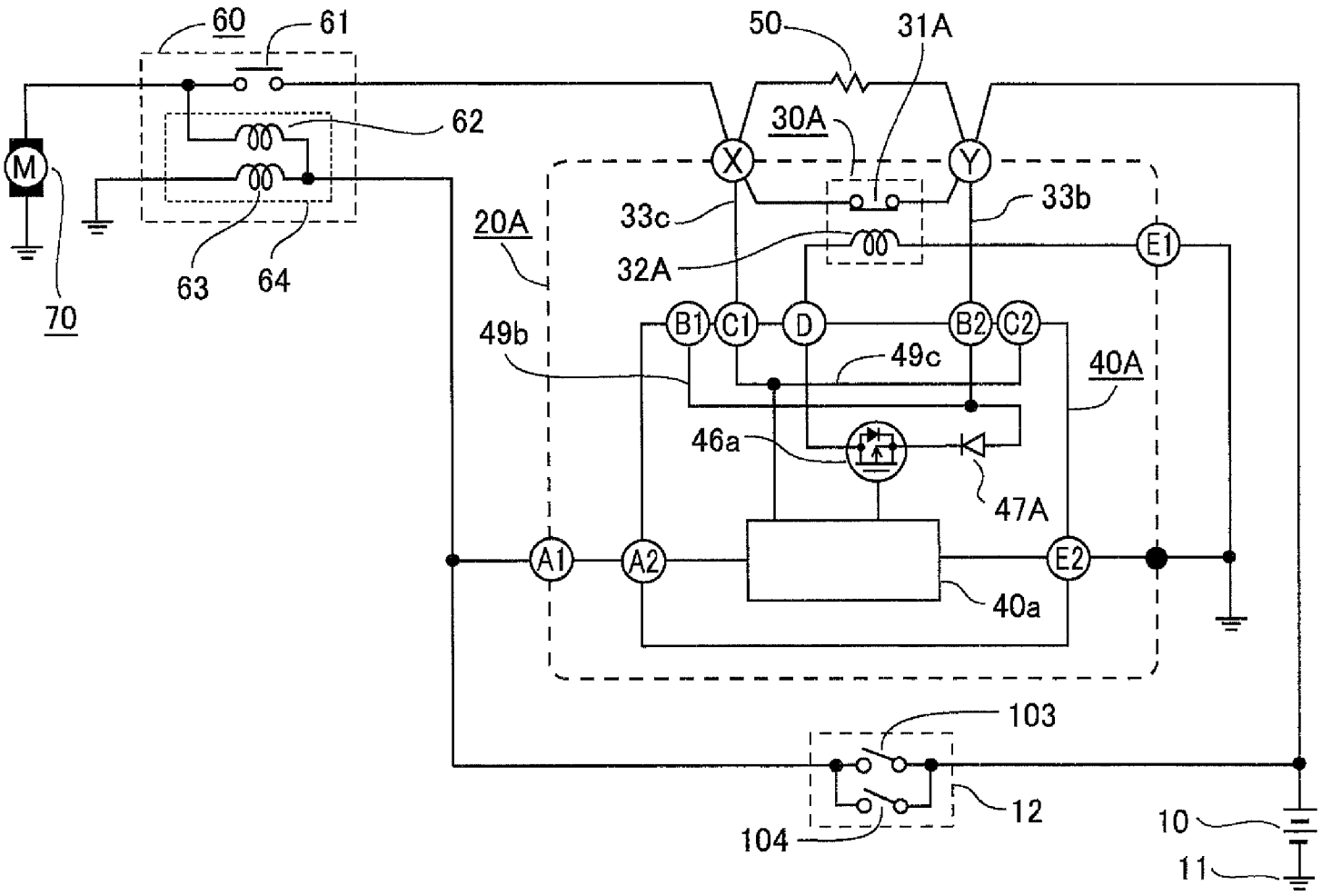
FIG. 1 is a diagram representing the connection between external devices and a starting control unit according to Embodiment 1 of the present invention.

FIG. 1 is a diagram representing the connection between external devices and a starting control unit according to Embodiment 1 of the present invention. In FIG. 1, the negative terminal of a vehicle battery 10 is connected with a vehicle body 11; by way of a starting command switch 12, electric power is supplied to a starting control unit 20A from the positive terminal of the vehicle battery 11. AS described later with reference to FIG. 2, the starting control unit 20A is mainly configured with a short-circuiting relay 30A and a timer circuit 40A; a current suppression resistor 50 is added on and integrated with the starting control unit 20A. The current suppression resistor 50 and an output contact 61 of an electromagnetic shift relay 60 are connected in series with each other; they are connected between the positive terminal of the vehicle battery 10 and a starter motor 70.

In the starting command switch 12, a manual starting switch 103, which is a key switch, and an automatic starting switch 104 for performing restarting after idling stop or remote warm-up operation in the cold season are connected in parallel with each other; electric power is supplied to the timer circuit 40A by way of command terminals A1 and A2 and to an attraction coil 62 and a holding coil 63 of the electromagnetic shift relay 60. In addition, as the starting command switch 12, there may be utilized an output contact 12 of a command electromagnet relay 105 in Embodiment 5 (refer to FIG. 16) described later.

A short-circuiting relay 30A is provided with a short-circuiting contact 31A, which is a normally closed contact; the short-circuiting contact 31A is opened by performing electric-power supply to and driving of an excitation coil 32A and is connected in parallel with the current suppression resistor 50 by way of wiring terminals X and Y. By way of a reverse connection protection device 47A, a driving transistor 46*a*, and a driving terminal D, electric power is supplied to the excitation coil 32A from power-source terminals B1 and B2 of the timer circuit 40A. The power-source terminals B1 and B2 are connected with each other through an inter-terminal connection lead 49*b*; the wiring terminal Y connected with the positive terminal of the vehicle battery 10 and the power-source terminal B2 are connected with each other through an inter-terminal connection strip 33*b*. A starting timer circuit unit 40*a* is formed of a light electric circuit unit obtained by removing the reverse connection protection device 47A and the driving transistor 46*a* from the timer circuit 40A.

Signal terminals C1 and C2 utilized for obtaining a timing starting signal for the timer circuit 40A are connected with each other through an inter-terminal connection lead 49*c*; the negative-side wiring terminal X of the current suppression resistor 50 and the signal terminal C1 are connected with each other through an inter-terminal connection strip 33*c*. As described later with reference to FIG. 2, immediately after the starting command switch 12 is closed, the driving transistor 46*a* is driven to be turned on, and then after a predetermined time set by the starting timer circuit unit 40*a*, the driving transistor 46*a* is turned off. The other terminal of the excitation coil 32A and the negative-side lead of the timer circuit 40A are connected with the vehicle body 11 by way of grand terminals E1 and E2, respectively; the negative terminal of the holding coil 63 of the electromagnetic shift relay 60 and the negative terminal of the starter motor 70 are also connected with the vehicle body 11.

The electromagnetic shift relay 60 is provided with a shift coil 64 configured with the holding coil 63 and the attraction coil 62 to which the vehicle battery 10 supplies electric power through starting command switch 12; the attraction coil 62 and the holding coil 63 collaborate with each other to propel a pinion gear provided on the starter motor 70 so that a ring gear provided on the crankshaft of the engine and the pinion gear engage with each other; as described later, the output contact 61 is closed so that the attraction coil 62 connected in series with the starter motor 70 is short-circuited and de-energized.

When the attraction coil 62 connected in series with the starter motor 70 is supplied with electric power and hence the output contact 61 is closed, both terminals of the attraction coil 62 are short-circuited by the starting command switch 12 and the current suppression resistor 50 or the short-circuiting contact 31A, which is the output contact of the short-circuiting relay 30A. In addition, the resistance value of the current suppression resistor 50 is considerably smaller than the resistance value of the attraction coil 62; therefore, the attraction coil 62 is de-energized, whereby the holding coil 63 keeps the electromagnetic shift relay 60 operative. However, when the starting command switch 12 is opened, a current, which reversely flows from the output contact 61 that has been closed to the attraction coil 62, flows in the holding coil 63; the magnetic force produced by the attraction coil 62 and the magnetic force produced by the holding coil 63 cancel out each other; and the electromagnetic shift relay 60 is restored.

Figure 2:
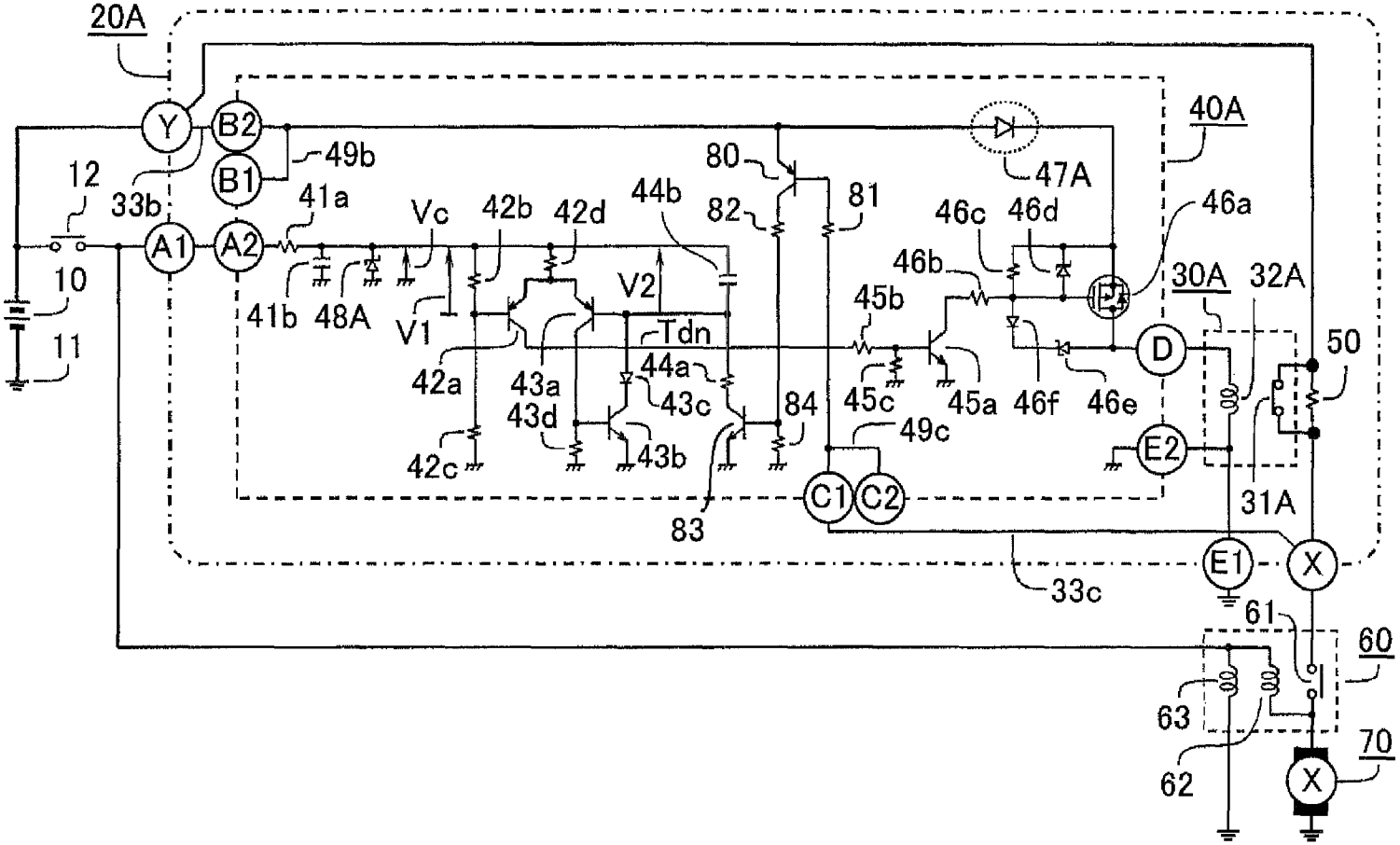
FIG. 2 is a diagram illustrating the internal circuit of a starting control unit according to Embodiment 1 of the present invention.

Next, the internal circuit of the starting control unit 20A represented in FIG. 1 will be explained with reference to FIG. 2. In FIG. 2, the wiring between the starting control unit 20A and the vehicle battery 10, the starting command switch 12, the electromagnetic shift relay 60, and the starter motor 70 that are provided outside the starting control unit 20A and the configuration of the power supply circuit for the short-circuiting relay 30A and the excitation coil 32A provided inside the starting control unit 20A are the same as those described with reference to FIG. 1.

The vehicle battery 10 supplies a driving power-source voltage Vc to the timer circuit 40A by way of the starting command switch 12, the command terminals A1 and A2, and a power-supply resistor 41*a*. The driving power-source voltage Vc is limited by a voltage limiting diode 48A not to become the same as or higher than a predetermined upper limit voltage; the driving power-source voltage Vc is smoothed by a power-source capacitor 41*b* so as not to become the same as or lower than a predetermined lower limit voltage even in the case where the power-source voltage Vb of the vehicle battery 10 temporally and abnormally drops. First and second comparison transistors 42*a* and 43*a* are PNP-type transistors to which the driving power-source voltage Vc is applied through a common emitter resistor 42*d*; a first comparison voltage V1 obtained by dividing the driving power-source voltage Vc by division resistors 42*b* and 42*c* is applied to the base terminal of the first comparison transistor 42*a*.

To the base terminal of the second comparison transistor 43*a*, there is applied a second comparison voltage V2, which is a gradually increasing voltage across a timer capacitor 44*b* that is charged by way of a charging resistor 44*a* and a timing start transistor 83 when a PNP-type conduction detection transistor 80 is turned on. The emitter terminal of the conduction detection transistor 80 is connected with the power-source terminal B2, and the base resistor 81 is connected with the signal terminal C1; while a current flows in the current suppression resistor 50, the voltage across the current suppression resistor 50 turns on the conduction detection transistor 80, and then the timing start transistor 83 is turned on by way of a command resistor 82. An open-circuit stabilizing resistor 84 for preventing erroneous conduction due to a dark current is connected between the emitter terminal and the base terminal of the NPN-type timing start transistor 83. The base terminal of an NPN-type latch transistor 43*b* and the collector terminal of the second comparison transistor 43*a* are connected with each other; when the value of the second comparison voltage V2 is the same as or higher than the first comparison voltage V1 and hence the second comparison transistor 43*a* turns on, the timer circuit 40A comes into the time-up state, whereby the latch transistor 43*b* turns on. As a result, by way of a holding power supply diode 43*c*, the second comparison transistor 43*a* is kept conductive, through the collector terminal of the latch transistor 43*b*.

Meanwhile, the driving transistor 46*a*, which supplies electric power from the vehicle battery 10 to the excitation coil 32A by way of the wiring terminal Y, the power-source terminal B2, and the reverse connection protection device 47A, is a P-channel field-effect transistor; the driving transistor 46*a* is turned on by way of division resistors 46*b* and 46*c* when an NPN-type driving auxiliary transistor 45*a* turns on. A division resistor 46*c* and an overvoltage protection diode 46*d* are connected between the source terminal of the driving transistor 46*a* and the gate terminal thereof. A reverse-current prevention diode 46*f* and a surge absorption diode 46*e* are connected between the gate terminal of the driving transistor 46*a* and the drain terminal thereof.

The driving auxiliary transistor 45*a* is turned on by a time-up output Tdn, which is the output of the first comparison transistor 42*a*, through a driving resistor 45*b*. During a period before the time-up, in which the first comparison transistor 42*a* is turned on, the logic level of the time-up output Tdn becomes "H" and turns on the driving auxiliary transistor 45*a*; however, during a period after the time-up, in which the latch transistor 43*b* is turned on, the first comparison transistor 42*a* is turned off, and hence the logic level of the time-up output Tdn becomes "L" and turns off the driving auxiliary transistor 45*a*.

In the case where the vehicle battery 10 is connected with a wrong polarity, the reverse connection protection device 47A prevents the reverse energization circuit, which consists of the positive terminal of the vehicle battery 10, the ground terminal E1, the excitation coil 32A, and the parasitic diode in the driving transistor 46*a*, from becoming conductive, so that a reverse current is prevented from flowing from the power-source terminal B2 to the negative terminal of the vehicle battery 10, by way of the wiring terminal Y.

In contrast, in the case where, when the mounting position of the starting control unit 20A is reversed, it is requested that the vehicle battery 10 is connected with the wiring terminal X and the electromagnetic shift relay 60 is connected with the wiring terminal Y, the inter-terminal connection strip 33*b* is connected between the wiring terminal X and the power-source terminal B1; therefore, the inter-terminal connection lead 49*b* is provided so that the vehicle battery 10 may be connected with either the power-source terminal B1 or the power-source terminal B2.

Similarly, in the case where, when the mounting position of the starting control unit 20A is reversed, it is requested that the vehicle battery 10 is connected with the wiring terminal X and the electromagnetic shift relay 60 is connected with the wiring terminal Y, the inter-terminal connection strip 33*c* is connected between the wiring terminal Y and the signal terminal C2. The inter-terminal connection lead 49*c* is provided so that the vehicle battery 10 may be connected with either the signal terminal C1 or the signal terminal C2.

Figure 3:
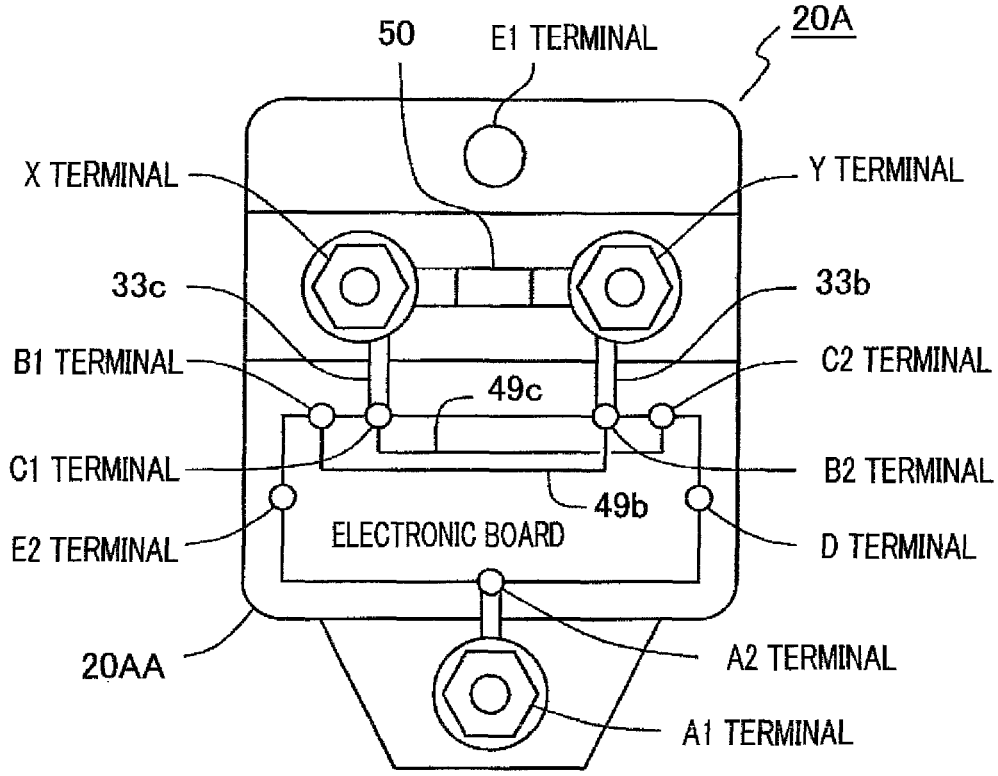
FIG. 3 is a view illustrating the top-surface configuration of a starting control unit according to Embodiment 1 of the present invention.
Figure 4:
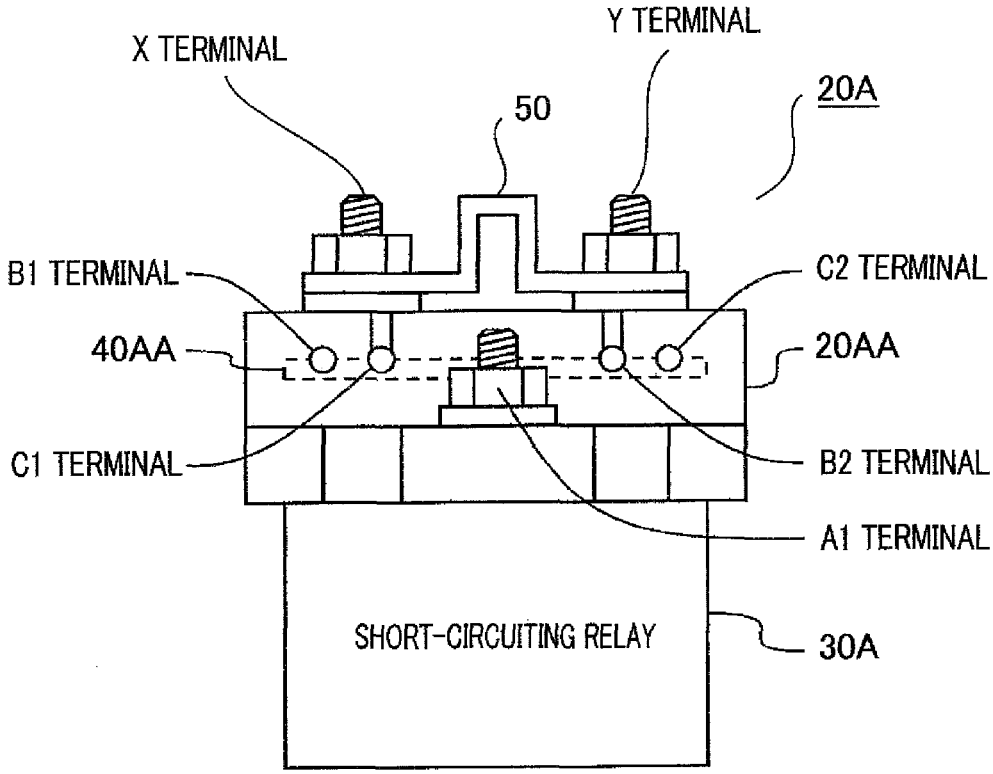
FIG. 4 is a diagram illustrating the side configuration of a starting control unit according to Embodiment 1 of the present invention.

Next, there will be explained FIGS. 3 and 4, which are the views of the top-surface configuration and the side configuration, respectively, of the starting control unit 20A according to Embodiment 1. In FIGS. 3 and 4, the starting control unit 20A is provided with the short-circuiting relay 30A mounted integrally with the bottom of a case 20AA; an electronic board 40AA that is situated inside the case 20AA and in which there are mounted circuit components included in the timer circuit 40A; the wiring terminals X and Y provided on the case 20AA; the command terminal A1; and the ground terminal E1.

On the electronic board 40AA, there are provided the command terminal A2, the power-source terminals B1 and B2, the signal terminals C1 and C2, the driving terminal D, and the ground terminal E2; one of the wiring terminals X and Y and one of the power-source terminals B1 and B2 are connected with each other by the inter-terminal connection strip 33*b*. The other one of the wiring terminals X and Y and one of the signal terminals C1 and C2 are connected with each other by the inter-terminal connection strip 33*c*; the command terminals A1 and A2 are connected with the ground terminals E1 and E2, respectively. The current suppression resistor 50 is fixed between the wiring terminals X and Y, by being screwed along with the wiring terminals X and Y; the resistance value of the current suppression resistor 50 is selectively determined in accordance with the typical characteristics of the starter motor 70 to be utilized.

Next, there will be explained the operation of the starting control unit 20A, configured as described above, according to Embodiment 1.

Figure 5A:
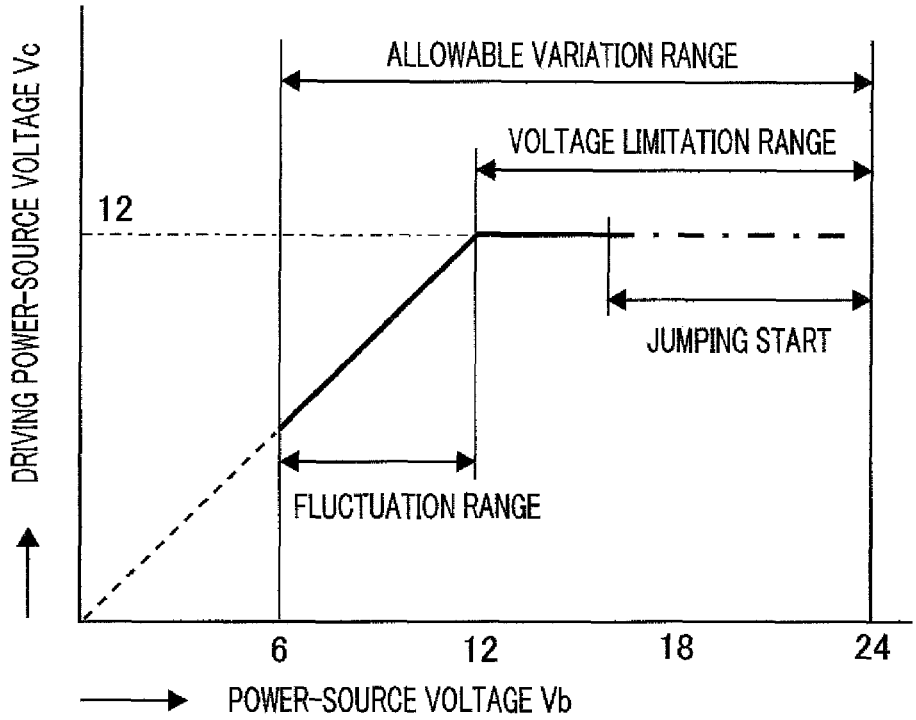
FIG. 5A is the characteristic curve of the driving voltage for the timer circuit of a starting control unit according to Embodiment 1 of the present invention.
Figure 5B:
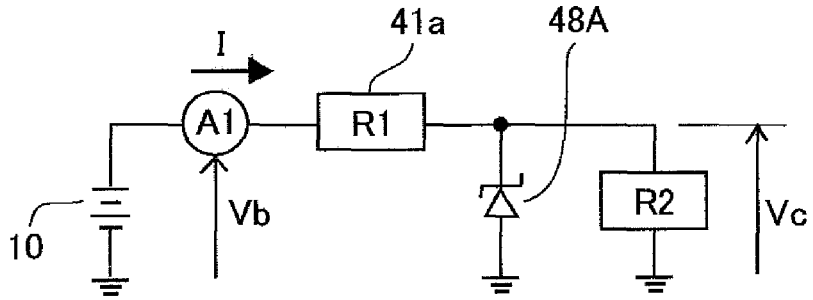
FIG. 5B is a partial circuit diagram for explaining the power consumption thereof.

At first, there will be explained FIG. 5A representing the characteristics of the driving voltage for the timer circuit and FIG. 5B representing the partial circuit for explaining the power consumption.

In FIG. 5A, the abscissa denotes the value of the power-source voltage Vb applied from 12V-type vehicle battery 10 to the command terminals A1 and A2 by way of the starting command switch 12; the value of the power-source voltage Vb with which the starting control unit 20A operates normally is, for example, DC 6 V to 24 V. In the case of a single 12V-type vehicle battery, the output voltage normally does not become the same as or higher than DC 16 V; however, assuming that a jumping start is performed by use of an external power source when the engine is started in the cold weather environment, the starting control unit 20A can operate at the upper limit voltage of, for example, DC 24 V, i.e., the allowable variation range is set to be from DC 6V to 24 V. In contrast, the driving power-source voltage Vc represented by the ordinate is limited by the voltage limiting diode 48A in FIG. 2; therefore, it rises as the power-source voltage Vb increases. The driving power-source voltage Vc is restricted not to become the same as or higher than DC 12 V, for example. Accordingly, the respective voltages applied to the power-source capacitor 41*b* and the timer capacitor 44*b* are suppressed, whereby small-size, inexpensive, and low-voltage capacitors can be utilized.

As described above, in the low voltage region where the power-source voltage Vb is from DC 6 V to 12 V, the driving power-source voltage Vc is not stabilized and varies in proportion to the power-source voltage Vb; however, because, as the first and second comparison voltages V1 and V2, the common driving power-source voltage Vc is utilized, the starting control unit 20A does not undergo the effect of the driving power-source voltage Vc during a period in which the second comparison voltage V2 is lower than the first comparison voltage V1. As a result, stable timer characteristics can be obtained.

However, when the driving power-source voltage Vc rapidly decreases before the time-up, the value of the first comparison voltage V1 that has rapidly decreased becomes smaller than the value of the second comparison voltage V2 that has been being charged, whereby there is caused a risk that a time-up erroneously occurs; however, in Embodiment 1, because, after the output contact 61 of the electromagnetic shift relay 60 is closed and hence the power-source voltage Vb temporarily decreases, the timing is started, this risk is eliminated. In the case where the limit voltage is set to be, for example, DC 5.1 V by the voltage limiting diode 48A, driving power-source voltage Vc can be stabilized over the whole voltage range; however, in this case, when the power-source voltage Vb increases, the power consumption of the whole timer circuit increases, resulting in the overheating of the starting control unit 20A.

In FIG. 5B, assuming that the resistance value of the power-supply resistor 41*a* (refer to FIG. 2) is R1 and the equivalent resistance of the whole timer circuit connected in parallel with the voltage limiting diode 48A is R2, the power consumption W of the whole timer circuit is calculated as follows.

In the case where the power-source voltage Vb is high and in the relationship of "Vc≤Vb×R2/(R1+R2)", the current I that flows in the power-supply resistor 41*a* is represented as "I=(Vb−Vc)/R1"; thud, the power consumption W is given by the following equation.

$$W=Vb\times I=Vb\times(Vb\times Vc)/R1$$

Accordingly, it can be seen that there exists a relationship where the power consumption W increases as the driving power-source voltage Vc decreases.

Figure 6:
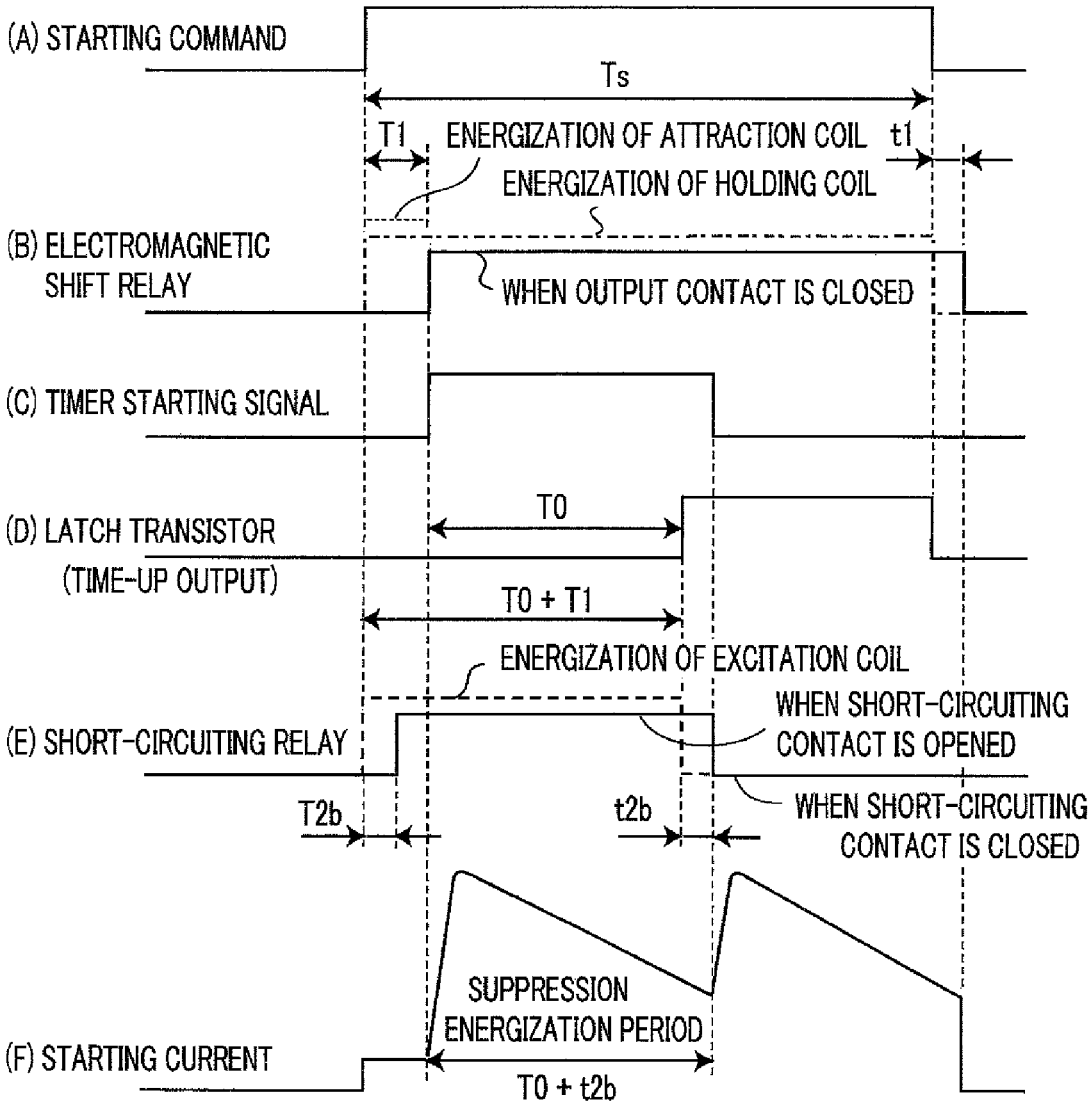
FIG. 6 is a timing chart for explaining the operation of a starting control unit according to Embodiment 1 of the present invention.

Next, the operation will be explained with reference to the timing chart in FIG. 6. The operation will be explained also with reference to FIGS. 1 and 2.

FIG. 6(A) represents the status of a command signal whose logic level becomes "H" during a circuit-closing command period Ts of the starting command switch 12. When the starting command switch 12 is closed, the attraction coil 62 and the holding coil of the electromagnetic shift relay 60 are energized, as illustrated in FIGS. 1 and 2, whereby the pinion gear of the starter motor 70 is driven to be pushed out in such a way as to engage with the ring gear of the engine, and when a closed-circuit response delay time T1 has elapsed, the output contact 61 is closed.

In FIG. 6(B), the dotted line denotes the energization period of the attraction coil 62 corresponding to the closed-circuit response delay time T1 of the electromagnetic shift relay 60; the dashed line denotes the energization period of the holding coil 63 corresponding to the circuit-closing command period Ts; the solid line denotes the closed-circuit period of the output contact 61. When the output contact 61 is closed, the attraction coil 62 is short-circuited by a series circuit consisting of the current suppression resistor 50 and the output contact 61; however, because the resistance value of the current suppression resistor 50 is considerably smaller than the resistance value of the attraction coil 62, the attraction coil 62 is de-energized, whereby the holding coil 63 keeps the electromagnetic shift relay 61 closed and the pinion gear pushed out. When the starting command switch 12 is opened and hence the holding coil 63 is de-energized, the output contact 61 is opened when an open-circuit response time t1 of the electromagnetic shift relay 60 has elapsed.

FIG. 6(C) represents a period in which the conduction detection transistor 80 is conductive because the output contact 61 is closed and hence a starting current flows in the starter motor 70 by way of the current suppression resistor 50; when the short-circuiting contact 31A returns to be closed in due course of time, the conduction detection transistor 80 becomes nonconductive. When the conduction detection transistor 80 becomes conductive, the timing start transistor 83 also becomes conductive and then charging of the timer capacitor 44*b* starts; after a delay setting time T0 elapses, the second comparison voltage V2 becomes the same as or higher than the first comparison voltage V1 and hence the second comparison transistor 43*a* becomes conductive; and the second comparison transistor 43*a* and the latch transistor 43*b* collaborate with each other, so that a self-holding conductive state is produced and then a time-up completion state is produced.

FIG. 6(D) represents a state in which the latch transistor 43*b*, which becomes conductive at a time instant when the delay setting time T0 elapses after the output contact 61 has closed, is conductive. When the starting command switch 12 is opened, the driving auxiliary transistor 45*a* is driven to be conductive by the first comparison transistor 42*a* by way of the driving resistor 45*b*, so that the driving transistor 46*a* is driven to be conductive; however, when, due to the time-up of the timer circuit, the latch transistor 43*b* becomes conductive, the first comparison transistor 42*a* becomes nonconductive; as a result, the driving auxiliary transistor 45*a* is turned off and hence the driving transistor 46*a* is also turned off.

In FIG. 6(E), the dotted line represents the energization period of the excitation coil 32A of the short-circuiting relay 30A; the excitation coil 32A is energized in a period from the time instant when the starting command switch 12 is closed to the time instant when the latch transistor 43*b* becomes conductive and hence the time-up output is generated. When the excitation coil 32A is energized, the short-circuiting contact 31A, which is normally closed, is opened after an open-circuit response time T2*b* of the short-circuiting relay 30A has elapsed; when the excitation coil 32A is de-energized, the short-circuiting contact 31A is returned to be closed after a closed-circuit response time t2*b* of the short-circuiting relay 30A has elapsed; the logic level "H" by a solid line represents a state in which the short-circuiting contact 31A is opened.

The open-circuit response time T2*b* of the short-circuiting relay 30A is shorter than the closed-circuit response time T1 of the electromagnetic shift relay 60; by the time the output contact 61 is closed, the short-circuiting contact 31A is opened. When the driving transistor 46*a* is turned off, the current that has been flowing in the excitation coil 32A is rapidly cut off by the surge absorption diode 46*e*; therefore, the closed-circuit response time t2*b* becomes shorter than the open-circuit response time T2*b* and hardly undergoes the effect of the power-source voltage.

FIG. 6(F) represents the waveform of a starting current that flows in the starter motor 70; when the starting command switch 12 is closed, an energization current for the attraction coil 62 flows in the starter motor 70; when the output contact 61 is closed in due course of time, the starting current rapidly increases through the current suppression resistor 50, and as the rotation speed of the starter motor 70 rises, the starting current gradually decreases. When the short-circuiting contact 31A is returned to be closed, the starting current rapidly increases again, and as the rotation speed of the starter motor 70 further rises, the starting current gradually decreases.

When the starting command switch 12 is opened as the engine autonomously rotates, the output contact 61 is opened after the open-circuit response time t1 (refer to FIG. 6(B)) of the electromagnetic shift relay 60 has elapsed, whereby the starting current is cut off. At a time immediately after the starting command switch 12 is opened, the output contact 61 is still closed; thus, an energization current flows from the attraction coil 62 to the holding coil 63 by way of the short-circuiting contact 31A and the output contact 61. In this case, the magnetic force by the attraction coil 62 and the magnetic force by the holding coil 63 works differentially; therefore, the electromagnetic shift relay 60 is returned to be de-energized.

Provided another low-resistance load is driven through the starting command switch 12, the load is connected in parallel with the holding coil 63; therefore, the voltage applied to the attraction coil 62 increases, and the voltage applied to the holding coil 63 decreases, whereby there may occur an error in which the balance of the differential magnetic forces is broken and hence the electromagnetic shift relay 60 continues its operation holding state. However, in the case of Embodiment 1 illustrated in FIG. 1, only the high-resistance timer circuit 40A is connected in parallel with the holding coil 63 and the excitation coil 32A is not connected in parallel with the holding coil 63; therefore, the electromagnetic shift relay 60 is not erroneously opened.

What makes it possible is that the excitation coil 32A is directly connected with the vehicle battery 10 by way of the reverse connection protection device 47A and the driving transistor 46*a*; however, in the energization period T0+T1 in FIG. 6(E), a current flows in the reverse connection protection device 47A and the driving transistor 46*a*, resulting in the temperature rise in the starting control unit 20A. In order to suppress the temperature rise, as is the case with Embodiment 3 (refer to FIG. 9) described later, a transistor can be utilized as the reverse connection protection device; however, in the case of Embodiment 1 illustrated in FIGS. 1 and 2, there is utilized the voltage limiting diode 48A, which is a type of relatively high voltage, for obtaining the driving power-source voltage Vc so that the power consumption for obtaining a stabilized voltage is suppressed; this is one of the significant measures.

Moreover, even when the circuit-closing command period Ts of the starting command switch 12 is prolonged, the period in which a current flows in the excitation coil 32A is fixed; thus, Embodiment 1 has an advantage in that there is no fear of overheating in the reverse connection protection device 47A and the driving transistor 46*a*.

In the foregoing explanation, the configuration is implemented in such a way that the positive terminal of the vehicle battery 10 may be connected with either the wiring terminal X or the wiring terminal Y; however, in the case where, in accordance with the arrangement relationship between the vehicle battery 10 and the starter motor 70, the mounting direction of the starting control unit 20A is changed so that the positions of the mounting pins thereof are changed, for example, by connecting the wiring terminal Y always with the positive terminal of the vehicle battery 10 and supplying electric power to the power-source terminal B2 by way of the inter-terminal connection strip 33*b*, the power-source terminal B1 and the inter-terminal connection lead 49*b* can be removed. In this case, the wiring terminal X is always the negative terminal of the current suppression resistor 50 and connected with the signal terminal C1 through the inter-terminal connection strip 33*c*; thus, the signal terminal C2 and the inter-terminal connection lead 49*c* can be removed.

In the foregoing explanation, as the reverse connection protection device 47A, a diode is utilized; however, instead of the diode, it is also possible to obtain a small-voltage-drop diode, by reversely biasing a transistor.

In the foregoing explanation, in order to detect that the output contact 61 of the electromagnetic shift relay 60 has been closed, the conduction detection transistor 80 is turned on by the voltage across the current suppression resistor 50 so that the charging of the timer capacitor 44*b* is started through the timing start transistor 83. However, it is also possible to remove the conduction detection transistor 80 and to supply electric power to the command resistor 82 from the voltage across the starter motor 70 so that the timing start transistor 83 is turned on. In this case, on the starting control unit 20A, there is required a new signal terminal that replaces the signal terminals C1 and C2, and it is required to connect the new signal terminal with the starter motor 70 by a signal wire.

In the foregoing explanation, the driving transistor 46*a* includes the surge absorption diode 46*e*; however, a surge absorption diode 46*e* replacing the surge absorption diode 46*e* may be connected between the source terminal and the drain terminal of the driving transistor 46*a*. These surge absorption diodes perform voltage suppression in such a way that the voltage thereacross does not become the same as or higher than DC 50 V. In this case, for example, when the output voltage of the vehicle battery 10 is DC 10 V, the current decreasing rate at a time when the excitation coil 32A is de-energized by opening the driving transistor 46*a* is five times as fast as the current rising rate at a time when electric power is supplied to the excitation coil 32A by closing the driving transistor 46*a*; thus, the closed-circuit response time t2*b* is shortened much more than the open-circuit response time T2*b* of the short-circuiting contact 31A. Respective mechanical response delay times are added to the open-circuit response time of the short-circuiting contact 31A and the closed-circuit response time; however, because being insusceptible to the fluctuation in the power-source voltage and stable, the mechanical response delay times cannot be factors of the fluctuation in the current suppression starting time.

As is clear from the foregoing explanation, the starting control unit 20A according to Embodiment 1 is connected between the starter motor 70 that starts a vehicle engine and the vehicle battery 10, and performs current-limiting starting of the starter motor 70.

The starting control unit 20A integrally includes the current suppression resistor 50 connected in series with the output contact 61 of the electromagnetic shift relay 60 provided on the starter motor 70; the short-circuiting relay 30A that short-circuits the current suppression resistor 50 with the short-circuiting contact 31A thereof; and the timer circuit 40A that closes the short-circuiting contact 31A at a predetermined time instant when the starting current decreases in response to the operation of the starting command switch 12.

The electromagnetic shift relay 60 propels the pinion gear provided on the starter motor 70 through the shift coil 64 that is supplied with electric power from the vehicle battery 10 by way of the starting command switch 12 so that the ring gear provided on the crankshaft of the engine and the pinion gear engage with each other, and the electromagnetic shift relay 60 makes the output contact 61 close through the shift coil 64.

The short-circuiting contact 31A is a normally closed contact which is opened by energizing the excitation coil 32A of the short-circuiting relay 30A; the excitation coil 32A is supplied with electric power directly from the vehicle battery 10 by way of one of the terminals of the current suppression resistor 50, the reverse connection protection device 47A, and the driving transistor 46*a*, excluding the starting command switch 12.

The reverse connection protection device 47A is a transistor or a diode that enables power supply to the excitation coil 32A when the vehicle battery 10 is connected with a normal polarity, but prevents the power supply to the excitation coil 32A when the vehicle battery 10 is connected with an abnormal reversed polarity.

The driving transistor 46*a* is driven to be turned on at the same time when the starting command switch 12 is closed and hence the shift coil 64 is energized; by the time the output contact 61 is closed, the short-circuiting contact 31A completes its circuit-opening operation.

The timer circuit 40A starts timing operation in response to the closing operation by the output contact 61 of the electromagnetic shift relay 60, and turns off the driving transistor 46*a* after the predetermined delay setting time T0 elapses.

A suppression starting current for the starter motor 70 flows in the current suppression resistor 50 during the time period obtained by adding the delay setting time T0 of the timer circuit 40A and the closed-circuit response time t2*b* from a time instant when the excitation coil 32A of the short-circuiting relay 30A is de-energized to a time instant when the short-circuiting contact 31A is returned to be closed.

Accordingly, power-source wiring for the excitation coil 32A of the short-circuiting relay 30A is not required and the energization current for the short-circuiting relay 30A does not flow in the starting command switch 12; therefore, there is a characteristic that, by suppressing the current capacity of the switch, the small-size and inexpensive starting command switch 12 can be utilized.

In the case where the shift coil 64 of the electromagnetic shift relay 60 is a type that has the attraction coil 62 and the holding coil 63, the excitation coil 32A of the short-circuiting relay 30A is not connected in parallel with the shift coil 64; thus, when the starting command switch 12 is opened, the electromagnetic shift relay 60 does not erroneously operate; therefore, there is a characteristic that circuit-opening operation can securely be implemented.

The current suppression starting time is determined by the delay setting time T0 of the timer circuit 40A and the closed-circuit restoration delay time t2*b* of the short-circuiting relay 30A, without undergoing the effect of the operation response time of the electromagnetic shift relay 60, or the open-circuit response time of the short-circuiting relay 30A, that varies depending on the value of the power-source voltage; thus, the effect of the fluctuation in the power-source voltage is reduced; therefore, there is a characteristic that the stable current suppression starting time can be obtained.

Because the current suppression resistor 50 is short-circuited by the short-circuiting contact 31A of the normally closed short-circuiting relay 30A, the energization of the current suppression resistor 50 and the excitation coil 32A of the short-circuiting relay 30A is interrupted; therefore, the starting control unit 20A is not overheated even in the case where the starting of the engine takes a long time; thus, there is a characteristic that downsizing is realized.

Moreover, there is a characteristic that, even in the case where the connection of the vehicle battery 10 is implemented with an erroneous polarity, there can be prevented an accident where the short-circuiting relay 30A is continuously energized and hence burns out.

The timer circuit 40A detects a voltage drop generated across the current suppression resistor 50 at a time when the output contact 61 of the electromagnetic shift relay 60 is closed and then starts its timing operation. That is to say, the timer circuit 40A is adapted to start the timing operation in response to the fact that a current is applied to the current suppression resistor 50.

Accordingly, there is a characteristic that, without increasing the number of signal wiring leads for the purpose of detecting the fact that the output contact 61 of the electromagnetic shift relay 60 has been closed, it can be detected through a signal inside the starting control unit 20A that the output contact 61 has been closed.

The timer circuit 40A compares the first comparison voltage V1 that is proportional to the driving power-source voltage Vc supplied from the vehicle battery 10 at a time when the starting command switch 12 is closed with the second comparison voltage V2 that is a gradually increasing charging voltage across the timer capacitor 44*b* charged from the common driving power-source voltage Vc by way of the charging resistor 44*a* at a time when the output contact 61 is closed; then, when both the first and second comparison voltages V1 and V2 coincide with each other after the predetermined delay setting time T0 has elapsed, the timer circuit 40A outputs the time-up output Tdn so as to turn off the driving transistor 46*a*. That is to say, the timer circuit 40A is adapted to operate with a non-stabilized power source supplied from the vehicle battery 10.

Therefore, there is a characteristic that, because no stabilized power-source circuit for driving the timer circuit 40A is utilized, the power consumption of the timer circuit 40A can be suppressed over a wide range of fluctuation in the power-source voltage, and that, because the voltage comparison circuit included in the timer circuit 40A operates with the common driving power-source voltage Vc, the timer characteristics do not fluctuate even when the driving power-source voltage Vc fluctuates, whereby a stabilized delay setting time can be obtained.

The power-supply resistor 41*a* and the voltage limiting diode 48A are connected with the driving power-source circuit of the timer circuit 40A; as the voltage limiting diode 48A, there is utilized a constant-voltage diode having an operating voltage with which the voltage limiting function works in the high-voltage range within the fluctuation range of the driving power-source voltage Vc but it does not work in the low-voltage range. In other words, the supply voltage to the timer circuit 40A is limited in such a way as to be constant only in the high-voltage range.

Accordingly, because constant-voltage control is not performed in the whole range of the wide fluctuation in the voltage applied to the starter motor 70, there is a characteristic that the power consumption in the high-voltage range can be suppressed and that, by lowering the withstanding voltage of the timer capacitor 44*b* utilized in the timer circuit 40A, a small-size and inexpensive capacitor can be utilized.

The current suppression resistor 50 is integrated with the starting control unit 20A by being mounted and fixed on the outer wall of the case 20AA containing the starting control unit 20A. In other words, the current suppression resistor 50 is added on the outer wall of the starting control unit 20A.

Accordingly, there is a characteristic that, compared with a type in which the current suppression resistor 50 is incorporated in the case 20AA of the starting control unit 20A, the temperature rise in the starting control unit 20A caused by the heat generated in the current suppression resistor 50 is suppressed, and the value of the current suppression resistor 50 can readily be changed in accordance with the type of a vehicle to which the starting control unit 20A is applied. The foregoing characteristic is demonstrated also in the case of starting control units 21A, 20B, and 21B in Embodiment 2, 3, and 4, respectively.

The parallel circuit consisting of the short-circuiting contact 31A, which is the output contact of the short-circuiting relay 30A, and the current suppression resistor 50 is connected between the vehicle battery 10 and the output contact 61 of the electromagnetic shift relay 60 connected with the starter motor 70; one of a pair of wiring terminals X and Y of the parallel circuit is connected with the vehicle battery 10.

The timer circuit 40A is provided with a pair of power-source terminals B1 and B2 that are internally connected with each other through the inter-terminal connection lead 49*b*; when the wiring terminal Y, which is one of the pair of wiring terminals X and Y, is connected with the vehicle battery 10, the wiring terminal Y is connected with the power-source terminal B2, which is one of the power-source terminals B1 and B2; when the wiring terminal X, which is the other one of the pair of wiring terminals X and Y, is connected with the vehicle battery 10, the wiring terminal X is connected with the power-source terminal B1, which is the other one of the power-source terminals B1 and B2. That is to say, the short-circuiting relay 30A is provided between the vehicle battery 10 and the electromagnetic shift relay 60, which is inseparably integrated with the starter motor 70, and the timer circuit 40A is provided with the pair of power-source terminals B1 and B2 that are internally connected with each other; thus, in accordance with the polarity of the pair of wiring terminals X and Y for the parallel circuit consisting of the short-circuiting contact 31A and the current suppression resistor 50, the power-source terminals to be connected with the parallel circuit can be selected.

Accordingly, there is a characteristic that, even in the case where the arrangement relationship among the vehicle battery 10, the starting control unit 20A, and the starter motor 70 changes depending on the vehicle type to which the starting control unit 20A is applied, the power-source wiring for the timer circuit 40A can readily be performed. The foregoing characteristic is demonstrated also in the case of starting control units 21A, 20B, and 21B in Embodiment 2, 3, and 4, respectively.

Embodiment 2

Figure 7:
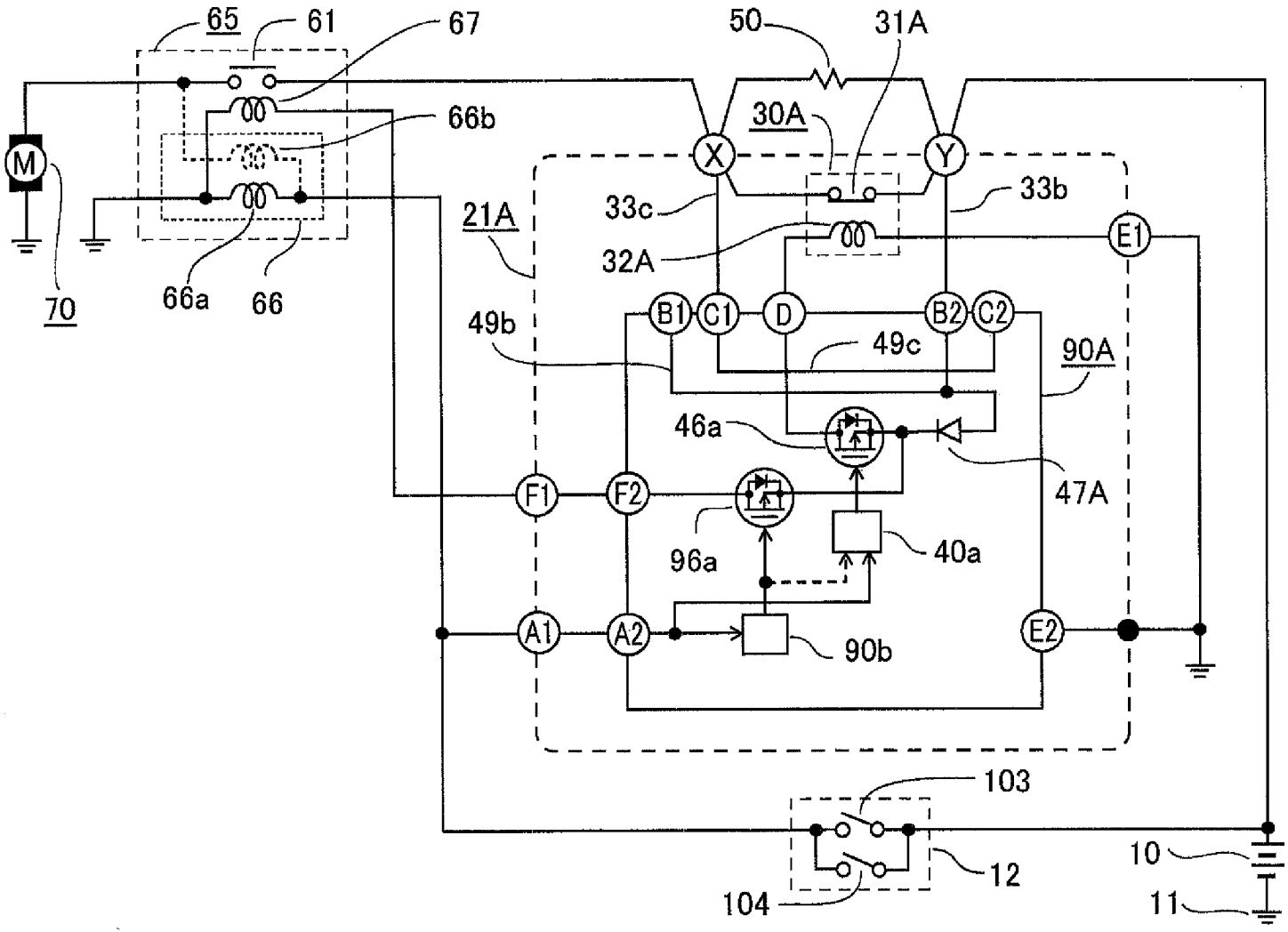
FIG. 7 is a diagram representing the connection between external devices and a starting control unit according to Embodiment 2 of the present invention.

Next, there will be explained a starting control unit according to Embodiment 2 of the present invention. FIG. 7 is a diagram representing the connection between external devices and a starting control unit according to Embodiment 2. Different points between Embodiments 1 and 2 will mainly be explained. In each of the drawings, the same reference characters denote the same or similar portions.

In FIG. 7, the negative terminal of the vehicle battery 10 is connected with the vehicle body 11; by way of the starting command switch 12, electric power is supplied to a starting control unit 21A from the positive terminal of the vehicle battery 11. The starting control unit 21A is mainly configured with the short-circuiting relay 30A and a timer circuit 90A; the current suppression resistor 50 is added on and integrated with the starting control unit 21A. The current suppression resistor 50 and the output contact 61 of an electromagnet shift relay 65 are connected in series with each other; they are connected between the positive terminal of the vehicle battery 10 and the starter motor 70.

In the starting command switch 12, the manual starting switch 103, which is a key switch, and the automatic starting switch 104 for performing restarting after idling stop or remote warm-up operation in the cold season are connected in parallel with each other; electric power is supplied to the timer circuit 90A by way of the command terminals A1 and A2 and to a shift coil 66 of the electromagnet shift relay 65. In addition, as the starting command switch 12, there may be utilized an output contact 12 of a command electromagnet relay 105 in Embodiment 6 (refer to FIG. 17) described later.

The short-circuiting relay 30A is provided with the short-circuiting contact 31A, which is a normally closed contact; the short-circuiting contact 31A is opened by performing electric-power supply to and driving of the excitation coil 32A and is connected in parallel with the current suppression resistor 50 by way of the wiring terminals X and Y. By way of the reverse connection protection device 47A, the driving transistor 46*a*, and the driving terminal D, electric power is supplied to the excitation coil 32A from the power-source terminals B1 and B2 of the timer circuit 90A. The power-source terminals B1 and B2 are connected with each other through the inter-terminal connection lead 49*b*; the wiring terminal Y connected with the vehicle battery 10 and the power-source terminal B2 are connected with each other through the inter-terminal connection strip 33*b*.

Signal terminals C1 and C2 utilized for obtaining a timing starting signal for the timer circuit 90A are connected with each other through the inter-terminal connection lead 49*c*; the negative-side wiring terminal X of the current suppression resistor 50 and the signal terminal C1 are connected with each other through the inter-terminal connection strip 33*c*. As is the case with Embodiment 2 (refer to FIG. 2), the starting timer circuit unit 40*a* drives and turns on the driving transistor 46*a* immediately after the starting command switch 12 is closed and performs delayed restoration operation of turning off the driving transistor 46*a* when a predetermined time elapses after the starting timer circuit unit 40*a* has started its timing operation.

In contrast, the delayed timer circuit unit 90*b* generates an time-up output so as to drive and turn on a separately driving transistor 96*a* when a predetermined delay time Td elapses after the starting command switch 12 has closed, so that electric power is supplied to a relay coil 67, described later, by way of the reverse connection protection device 47A, the separately driving transistor 96*a*, and driving terminals F2 and F1. The reverse connection protection device 47A may be connected with the driving transistor 46*a* and the separately driving transistor 96*a* so that concentration of heat can be prevented.

The electromagnetic shift relay 65 is provided with the shift coil 66 that is supplied with electric power from the vehicle battery 10 by way of the starting command switch 12; when the shift coil 66 is supplied with electric power, the electromagnetic shift relay 65 propels the pinion gear provided on the starter motor 70 so that the ring gear provided on the crankshaft of the engine and the pinion gear engage with each other.

The shift coil 66 is formed of a first coil 66*a* that performs attraction operation and holding operation; however, a second coil 66*b* for assisting the attraction operation may concurrently be utilized. However, in the case where the second coil 66*b* is concurrently utilized, because the relay coil 67 is separately provided so as to close the output contact 61, the second coil 66*b* connected in series with the starter motor 70 is short-circuited to be de-energized when the relay coil 67 is energized so as to close the output contact 61.

In this type of the electromagnetic shift relay 65, the relay coil 67 for closing the output contact 61 and the shift coil 66 for pushing out the pinion gear are mechanically separated from each other; thus, the output contact 61 can be closed after the shift operation has securely been implemented. The delay time Td from a time instant when the shift coil 66 is energized to a time instant when the relay coil 67 is energize is set by the delayed timer circuit unit 90*b*; the value of the delay time Td is a fixed value corresponding to the maximum shift time at a time when the power-source voltage Vb of the vehicle battery 10 is low; in contrast, in the case where the power-source voltage Vb is high, there is implemented voltage correction for gradually shortening the delay time Td.

The starting timer circuit unit 40*a* is supplied with electric power at a time instant when the starting command switch 12 is closed; however, in order to save electricity, the power supply to the starting timer circuit unit 40*a* may be implemented at a time instant when the delayed timer circuit unit 90*b* comes into the time-up state.

In the case where the shift coil 66 has the second coil 66*b* connected in series with the starter motor 70, when the relay coil 67 is supplied with electric power and hence the output contact 61 is closed, both terminals of the second coil 66*b* are short-circuited by the starting command switch 12 and the current suppression resistor 50 or the short-circuiting contact 31A, which is the output contact of the short-circuiting relay 30A. The resistance value of the current suppression resistor 50 is considerably smaller than the resistance value of the second coil 66*b*; therefore, the second coil 66*b* is de-energized, whereby the first coil 66*a* keeps the electromagnet shift relay 65 operative. However, when the starting command switch 12 is opened, the relay coil 67 is de-energized, and the output contact 61 is separately returned to be opened; then, both the first and second coils 66*a* and 66*b* are de-energized, so that the pinion gear is restored.

Figure 8:
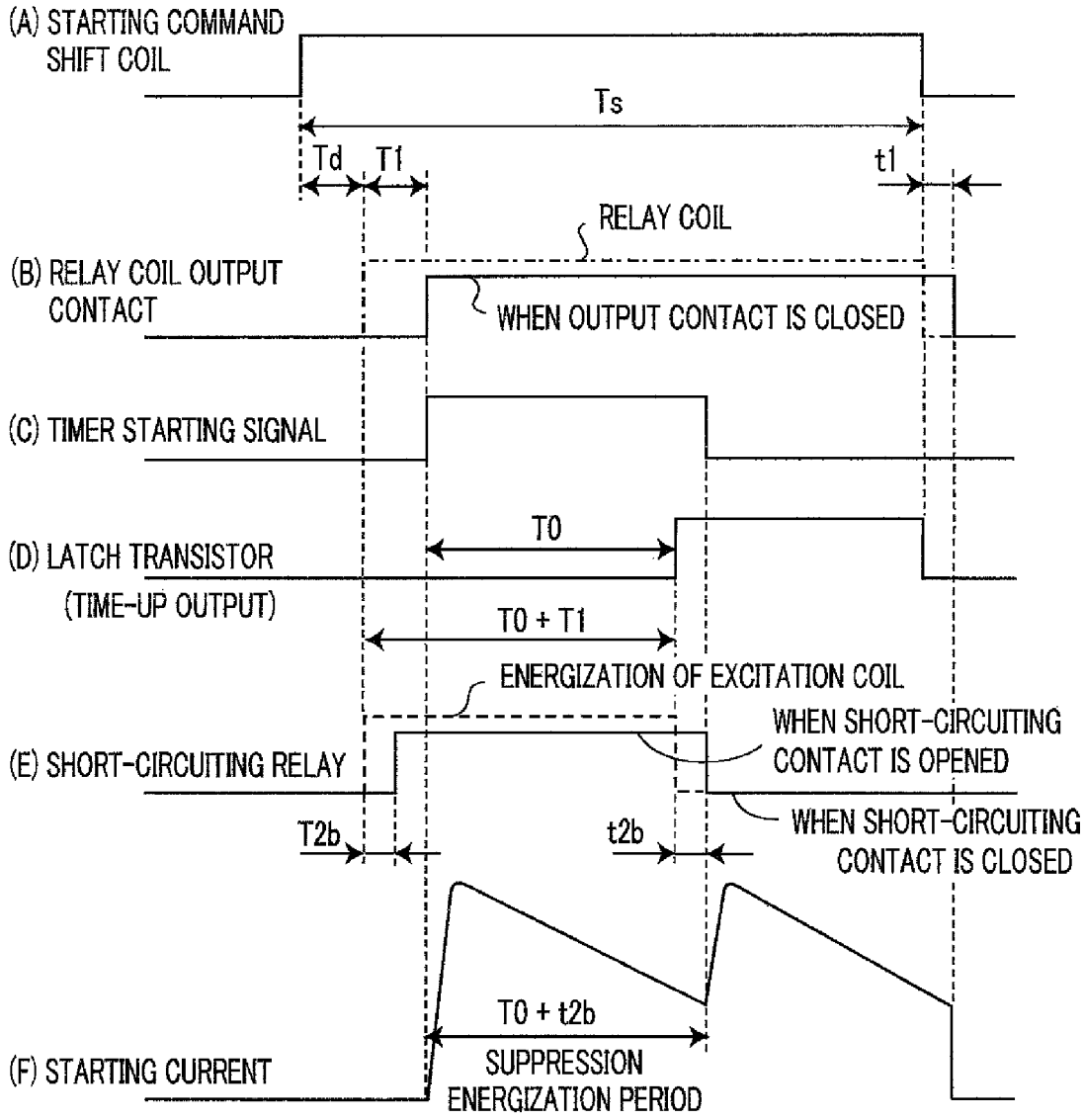
FIG. 8 is a timing chart for explaining the operation of a starting control unit according to Embodiment 2 of the present invention.

Next, the operation of the starting control unit 21A according to Embodiment 2 will be explained with reference to the timing chart in FIG. 8. The operation will be explained also with reference to FIGS. 7 and 2.

FIG. 8(A) represents the status of a command signal whose logic level becomes "H" during a circuit-closing command period Ts of the starting command switch 12. When the starting command switch 12 is closed, the shift coil 66 of the electromagnet shift relay 65 is energized, as illustrated in FIG. 7, whereby the pinion gear provided on the starter motor 70 is pushed out in such a way as to engage with the ring gear of the engine.

In FIG. 8(B), the dotted line represents the energization period of the relay coil 67, of the electromagnetic shift relay 65, that is energized by the delayed timer circuit unit 90*b* after a delay time Td elapses; the solid line denotes the closed-circuit period of the output contact 61 that closes after a closed-circuit response delay time T1 elapses. When the starting command switch 12 is opened and hence the relay coil 67 is de-energized, the output contact 61 is opened when an open-circuit response time t1 of the electromagnet shift relay 65 has elapsed.

FIG. 8(C) represents a period in which the conduction detection transistor 80 in FIG. 2 is conductive because the output contact 61 is closed and hence a starting current flows in the starter motor 70 by way of the current suppression resistor 50; when the short-circuiting contact 31A returns to be closed in due course of time, the conduction detection transistor 80 becomes nonconductive. When the conduction detection transistor 80 becomes conductive, the timing start transistor 83 also becomes conductive and then charging of the timer capacitor 44*b* starts; after a delay setting time T0 elapses, the second comparison voltage V2 becomes the same as or higher than the first comparison voltage V1 and hence the second comparison transistor 43*a* becomes conductive; and the second comparison transistor 43*a* and the latch transistor 43*b* collaborate with each other, so that a self-holding conductive state is produced and then a time-up completion state is produced.

FIG. 8(D) represents a state in which the latch transistor 43*b*, which becomes conductive at a time instant when a delay setting time T0 elapses after the output contact 61 has closed, is conductive. When the starting command switch 12 is opened, the driving auxiliary transistor 45*a* is driven to be conductive by the first comparison transistor 42*a* by way of the driving resistor 45*b*, so that the driving transistor 46*a* is driven to be conductive; however, when, due to the time-up of the timer circuit 90A, the latch transistor 43*b* becomes conductive, the first comparison transistor 42*a* becomes nonconductive; as a result, the driving auxiliary transistor 45*a* is turned off and hence the driving transistor 46*a* is also turned off.

In FIG. 8(E), the dotted line represents the energization period of the excitation coil 32A of the short-circuiting relay 30A; the excitation coil 32A is energized in a period from the time instant when the relay coil 67 is energized to the time instant when the latch transistor 43*b* becomes conductive and hence the time-up output is generated. When the excitation coil 32A is energized, the short-circuiting contact 31A, which is normally closed, is opened after an open-circuit response time T2*b* of the short-circuiting relay 30A has elapsed; when the excitation coil 32A is de-energized, the short-circuiting contact 31A is returned to be closed after a closed-circuit response time t2*b* of the short-circuiting relay 30A has elapsed; the logic level "H" by a solid line represents a state in which the short-circuiting contact 31A is opened.

The open-circuit response time T2*b* of the short-circuiting relay 30A is shorter than the closed-circuit response time T1 of the electromagnet shift relay 60; by the time the output contact 61 is closed, the short-circuiting contact 31A is opened. For that purpose, the energization of the excitation coil 32A may be started at the same time when the shift coil 66 is energized, after the starting command switch 12 has been closed.

When the driving transistor 46*a* is turned off, the current that has been flowing in the excitation coil 32A is rapidly cut off by the surge absorption diode 46*e*; therefore, the closed-circuit response time t2*b* becomes shorter than the open-circuit response time T2*b* and hardly undergoes the effect of the power-source voltage Vb of the vehicle battery 10.

FIG. 8(F) represents the waveform of a starting current that flows in the starter motor 70; when the starting command switch 12 is closed and after the delay time Td and the closed-circuit response time T1 elapses, the output contact 61 is closed, the starting current rapidly increases through the current suppression resistor 50; then, the starting current gradually decreases as the rotation speed of the starter motor 70 rises. When the short-circuiting contact 31A is returned to be closed, the starting current rapidly increases again, and as the rotation speed of the starter motor 70 further rises, the starting current gradually decreases.

When the starting command switch 12 is opened as the engine autonomously rotates, the output contact 61 is opened after the open-circuit response time t1 (refer to FIG. 8(B)) of the electromagnet shift relay 60 has elapsed, whereby the starting current is cut off.

In the energization period T0+T1 in FIG. 8(E), a current flows in the reverse connection protection device 47A and the driving transistor 46*a*, resulting in the temperature rise in the starting control unit 21A. In order to suppress the temperature rise, as is the case with Embodiment 3 (refer to FIG. 10) described later, a transistor can be utilized as the reverse connection protection device 47A; however, in the case of Embodiments 1 and 2, there is utilized the voltage limiting diode 48A, which is a type of relatively high voltage, for obtaining the driving power-source voltage Vc so that the power consumption for obtaining a stabilized voltage is suppressed; this is one of the significant measures.

Moreover, even when the circuit-closing command period Ts of the starting command switch 12 is prolonged, the period in which a current flows in the excitation coil 32A is fixed; thus, Embodiment 2 has an advantage in that there is no fear of overheating in the reverse connection protection device 47A and the driving transistor 46*a*.

As is clear from the foregoing explanation, the starting control unit 21A according to Embodiment 2 is connected between the starter motor 70 that starts a vehicle engine and the vehicle battery 10, and performs current-limiting starting of the starter motor 70.

The starting control unit 21A integrally includes the current suppression resistor 50 connected in series with the output contact 61 of the electromagnetic shift relay 65 provided on the starter motor 70; the short-circuiting relay 30A that short-circuits the current suppression resistor 50 with the short-circuiting contact 31A thereof; and the timer circuit 90A that closes the short-circuiting contact 31A at a predetermined time instant when the starting current decreases in response to the operation of the starting command switch 12.

The electromagnetic shift relay 65 propels the pinion gear provided on the starter motor 70 through the shift coil 66 that is supplied with electric power from the vehicle battery 10 by way of the starting command switch 12 so that the ring gear provided on the crankshaft of the engine and the pinion gear engage with each other, and the electromagnetic shift relay 65 makes the output contact 61 close through the relay coil 67 provided separately from the shift coil 66.

The short-circuiting contact 31A is a normally closed contact which is opened by energizing the excitation coil 32A of the short-circuiting relay 30A; the excitation coil 32A is supplied with electric power directly from the vehicle battery 10 by way of one of the terminals of the current suppression resistor 50, the reverse connection protection device 47A, and the driving transistor 46*a*, excluding the starting command switch 12.

The reverse connection protection device 47A is a transistor or a diode that enables power supply to the excitation coil 32A when the vehicle battery 10 is connected with a normal polarity, but prevents the power supply to the excitation coil 32A when the vehicle battery 10 is connected with an abnormal reversed polarity.

The driving transistor 46*a* is driven to be turned on at the same time when the starting command switch 12 is closed and hence the shift coil 66 or the relay coil 67 is energized; by the time the output contact 61 is closed, the short-circuiting contact 31A completes its circuit-opening operation.

The timer circuit 90A starts timing operation in response to the closing operation by the output contact 61 of the electromagnetic shift relay 65, and turns off the driving transistor 46*a* after the predetermined delay setting time T0 elapses; a suppression starting current for the starter motor 70 flows in the current suppression resistor 50 during the time period obtained by adding the delay setting time T0 of the timer circuit 90A and the closed-circuit response time t2*b* from a time instant when the excitation coil 32A of the short-circuiting relay 30A is de-energized to a time instant when the short-circuiting contact 31A is returned to be closed.

The electromagnetic shift relay 65 propels the pinion gear provided on the starter motor 70 through the shift coil 66 that is supplied with electric power from the vehicle battery 10 by way of the starting command switch 12 so that the ring gear provided on the crankshaft of the engine and the pinion gear engage with each other, and the electromagnetic shift relay 65 makes the output contact 61 close by separately driving the relay coil 67 provided separately from the shift coil 66.

The relay coil 67 is supplied with electric power to be driven when a predetermined delay time Td, which is set by the delayed timer circuit unit 90*b* provided in the timer circuit 90A, elapses after the shift coil 66 has been supplied with electric power; the value of the delay time Td is a fixed value corresponding to the maximum shift time at a time when the power-source voltage Vb of the vehicle battery 10 is low; in contrast, in the case where the power-source voltage Vb is high, there is implemented voltage correction for gradually shortening the delay time Td.

The short-circuiting contact 31A is a normally closed contact which is opened by energizing the excitation coil 32A of the short-circuiting relay 30A.

The starting timer circuit unit 40*a* provided in the timer circuit 90A starts its timing operation when the output contact 61 is closed.

The excitation coil 32A and the relay coil 67 are supplied with electric power directly from the vehicle battery 10 by way of one of the terminals of the current suppression resistor 50, the reverse connection protection device 47A, and the driving transistor 46*a*, excluding the starting command switch 12.

The reverse connection protection device 47A is a transistor or a diode that enables power supply to the excitation coil 32A and the relay coil 67 when the vehicle battery 10 is connected with a normal polarity, but prevents the power supply to the excitation coil 32A and the relay coil 67 when the vehicle battery 10 is connected with an abnormal reversed polarity.

As described above, the starting control unit 21A according to Embodiment 2 is provided with the delayed timer circuit unit 90*b* that energizes the relay coil 67 when a predetermined time elapses after the shift coil 66 of the electromagnetic shift relay 65 has been energized; and the starting timer circuit unit 40*a* that performs current-limiting starting by use of the current suppression resistor 50 that is short-circuited with the short-circuiting contact 31A of the short-circuiting relay 30A connected in series with the starter motor 70, in a predetermined period after the energization of the electromagnetic shift relay 65 has been started. The relay coil 67 and the short-circuiting relay 30A are supplied with electric power directly from the vehicle battery 10 by way of the reverse connection protection device 47A and the discrete driving transistor 46*a* and 96*a*, excluding the starting command switch 12.

Accordingly, power-source wiring for the excitation coil 32A of the short-circuiting relay 30A is not required and the energization currents for the relay coil 67 and the short-circuiting relay 30A do not flow in the starting command switch 12; therefore, there is a characteristic that, by suppressing the current capacity of the switch, the small-size and inexpensive starting command switch 12 can be utilized.

The electromagnetic shift relay 65 is divided into the shift coil 66 and the relay coil 67; therefore, there is a characteristic that, by suppressing the energization current for the relay coil 67, the heat generated in the reverse connection protection device 47A and the driving transistors 46*a* and 96*a* can be suppressed.

The relay coil 67 is energized after the pinion gear starts its shifting operation; therefore, even when the shifting time changes due to the fluctuation in the power-source voltage, there is stabilized the time from a time instant when the starting command switch 12 is closed to a time instant when the relay coil 67 is energized; as a result, there is a characteristic that the temporal characteristic of the current-limiting starting control can be stabilized.

Although the shift coil 66 of the electromagnetic shift relay 65 works not only as the first coil 66*a* that performs the attraction operation and the holding operation but also as the second coil 66*b* for assisting the attraction operation, the relay coil 67 drives the output contact 61 regardless of the state of the shift coil 66; therefore, when the starting command switch 12 is opened, the electromagnetic shift relay 65 does not erroneously operate; thus, there is a characteristic that circuit-opening operation can securely be implemented.

Moreover, there is a characteristic that, even in the case where the connection of the vehicle battery 10 is implemented with an erroneous polarity, there can be prevented an accident where the short-circuiting relay 30A and the relay coil 67 are continuously energized and hence burn out.

Embodiment 3

Figure 9:
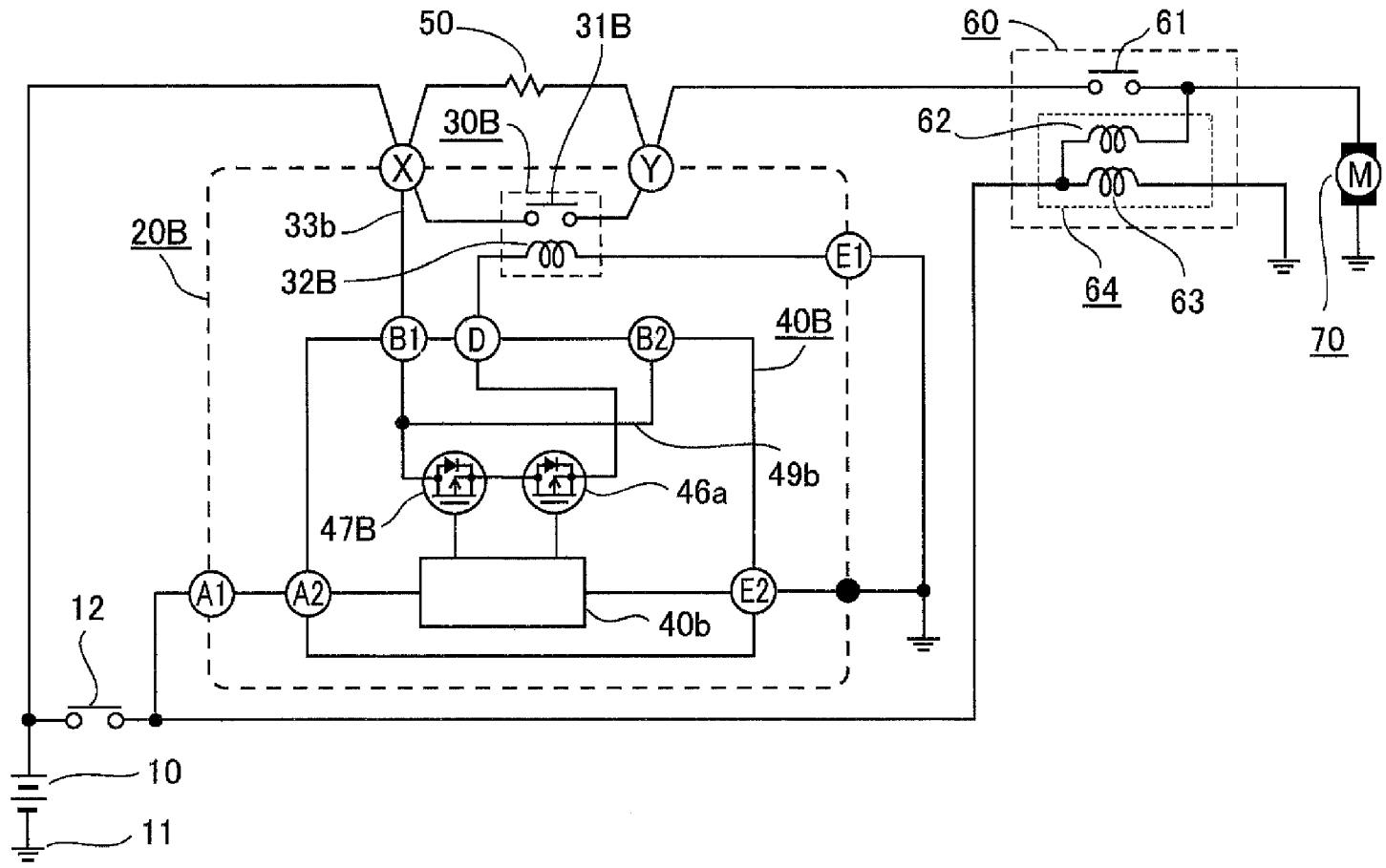
FIG. 9 is a diagram representing the connection between external devices and a starting control unit according to Embodiment 3 of the present invention.

Next, there will be explained a starting control unit according to Embodiment 3 of the present invention. FIG. 9 is a diagram representing the connection between external devices and a starting control unit according to Embodiment 3. In FIG. 9, the negative terminal of the vehicle battery 10 is connected with the vehicle body 11; by way of the starting command switch 12, electric power is supplied to a starting control unit 20B from the positive terminal of the vehicle battery 11. AS described later with reference to FIG. 10, the starting control unit 20B is mainly configured with a short-circuiting relay 30B and a timer circuit 40B; the current suppression resistor 50 is added on and integrated with the starting control unit 20B. The current suppression resistor 50 and an output contact 61 of an electromagnet shift relay 60 are connected in series with each other; they are connected between the positive terminal of the vehicle battery 10 and a starter motor 70.

Although omitted in FIG. 9, as is the case with Embodiment 1, in the starting command switch 12, the manual starting switch, which is a key switch, and the automatic starting switch for performing restarting after idling stop or remote warm-up operation in the cold season are connected in parallel with each other; electric power is supplied to the timer circuit 40B by way of the command terminals A1 and A2 and to the attraction coil 62 and the holding coil 63 of the electromagnet shift relay 60. In addition, as the starting command switch 12, there may be utilized an output contact 12 of a command electromagnet relay 105 in Embodiment 5 (refer to FIG. 16) or Embodiment 7 (refer to FIG. 18), described later.

The short-circuiting relay 30B is provided with a short-circuiting contact 31B, which is a normally opened contact; the short-circuiting contact 31B is closed by performing electric-power supply to and driving of an excitation coil 32B and is connected in parallel with the current suppression resistor 50 by way of the wiring terminals X and Y. By way of a reverse connection protection device 47B, the driving transistor 46*a*, and the driving terminal D, electric power is supplied to the excitation coil 32B from power-source terminals B1 and B2 of the timer circuit 40B; the power-source terminals B1 and B2 are connected with each other through the inter-terminal connection lead 49*b*. The wiring terminal X and the power-source terminal B1 connected with the vehicle battery 10 are connected with each other through the inter-terminal connection strip 33*b*.

A starting timer circuit unit 40*b* is formed of a light electric circuit unit obtained by removing the reverse connection protection device 47B and the driving transistor 46*a* from the timer circuit 40B. The other terminal of the excitation coil 32B and the negative-side lead of the timer circuit 40B are connected with the vehicle body 11 by way of grand terminals E1 and E2, respectively; the negative terminal of the holding coil 63 of the electromagnetic shift relay 60 and the negative terminal of the starter motor 70 are also connected with the vehicle body 11.

The electromagnet shift relay 60 is provided with the shift coil 64 configured with the holding coil 63 and the attraction coil 62 to which the vehicle battery 10 supplies electric power through starting command switch 12; the attraction coil 62 and the holding coil 63 collaborate with each other to propel a pinion gear provided on the starter motor 70 so that a ring gear provided on the crankshaft of the engine and the pinion gear engage with each other; as described later, the output contact 61 is closed so that the attraction coil 62 connected in series with the starter motor 70 is short-circuited and de-energized.

When the attraction coil 62 connected in series with the starter motor 70 is supplied with electric power and hence the output contact 61 is closed, both terminals of the attraction coil 62 are short-circuited by the starting command switch 12 and the current suppression resistor 50 or the short-circuiting contact 31B, which is the output contact of the short-circuiting relay 30B. In addition, the resistance value of the current suppression resistor 50 is considerably smaller than the resistance value of the attraction coil 62; therefore, the attraction coil 62 is de-energized, whereby the holding coil 63 keeps the electromagnet shift relay 60 operative. However, when the starting command switch 12 is opened, a current, which reversely flows from the output contact 61 that has been closed to the attraction coil 62, flows in the holding coil 63; the magnetic force produced by the attraction coil 62 and the magnetic force produced by the holding coil 63 cancel out each other; and the electromagnet shift relay 60 is restored.

Figure 10:
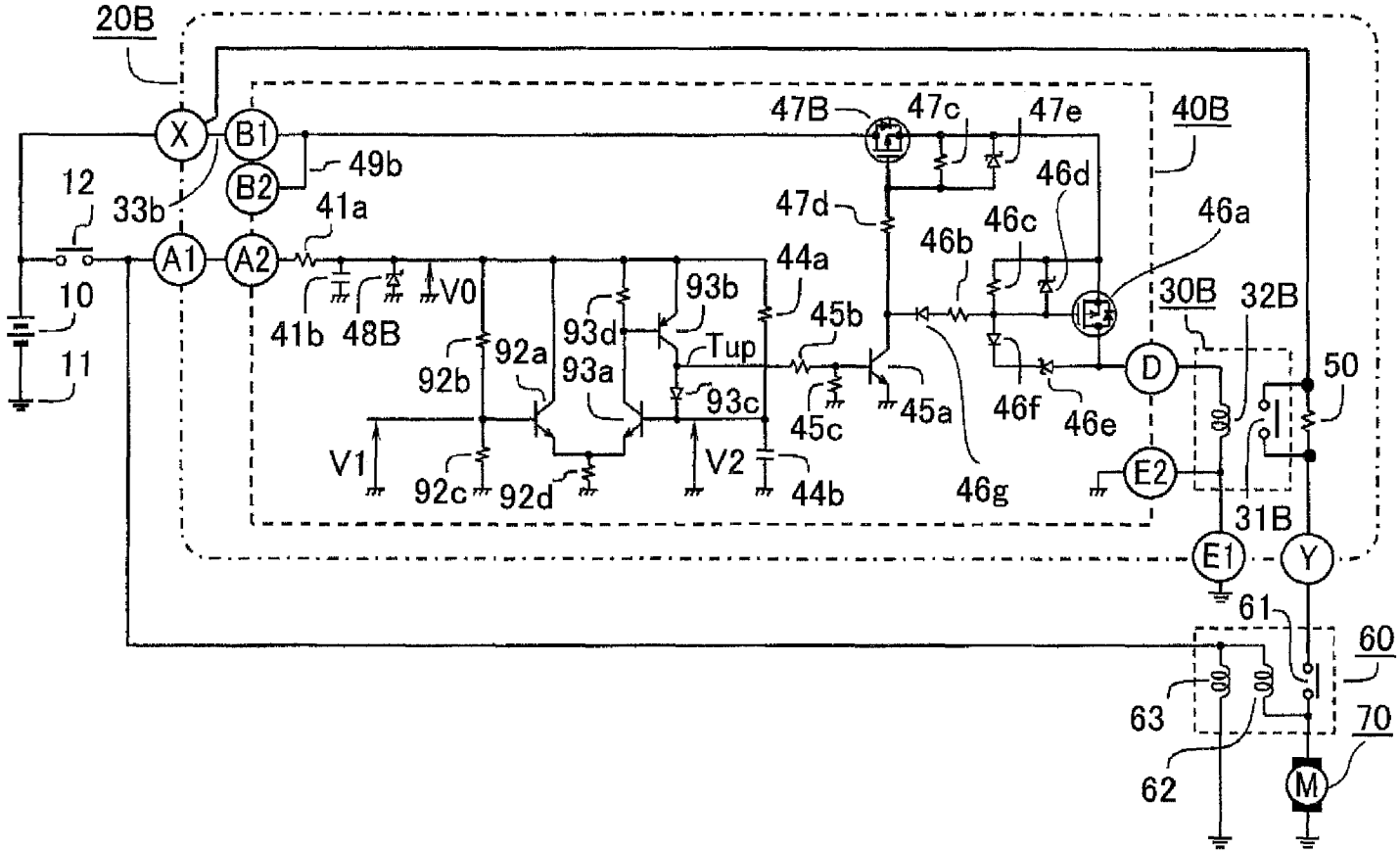
FIG. 10 is a diagram illustrating the internal circuit of a starting control unit according to Embodiment 3 of the present invention.

Next, the internal circuit of the starting control unit 20B represented in FIG. 9 will be explained with reference to FIG. 10. In FIG. 10, the wiring between the starting control unit 20B and the vehicle battery 10, the starting command switch 12, the electromagnet shift relay 60, and the starter motor 70 that are provided outside the starting control unit 20B and the configuration of the power supply circuit for the short-circuiting relay 30B and the excitation coil 32B provided inside the starting control unit 20B are the same as those described with reference to FIG. 9.

The vehicle battery 10 supplies a driving power-source voltage V0 to the timer circuit 40B by way of the starting command switch 12, the command terminals A1 and A2, and the power-supply resistor 41*a*. By means of a constant voltage diode 48B, the driving power-source voltage V0 is limited to be a constant value, for example, DC 5.1 V; the driving power-source voltage V0 is smoothed by the power-source capacitor 41*b* so as not to become the same as or lower than a predetermined lower limit voltage even in the case where the power-source voltage Vb of the vehicle battery 10 temporally and abnormally drops. First and second comparison transistors 92*a* and 93*a* to which the driving power-source voltage V0 is applied are NPN-type transistors, which are connected to the ground by way of a common emitter resistor 92*d*; a first comparison voltage V1 obtained by dividing the driving power-source voltage V0 by division resistors 92*b* and 92*c* is applied to the base terminal of the first comparison transistor 92*a*.

To the base terminal of the second comparison transistor 93*a*, there is applied a second comparison voltage V2, which is a gradually increasing voltage across the timer capacitor 44*b* that is charged from the driving power-source voltage V0 by way of a charging resistor 44*a*. The base terminal of an PNP-type latch transistor 93*b* and the collector terminal of the second comparison transistor 93*a* are connected with each other; when the value of the second comparison voltage V2 is the same as or higher than the first comparison voltage V1 and hence the second comparison transistor 93*a* turns on, the timer circuit comes into the time-up state, whereby the latch transistor 93*b* turns on. As a result, by way of a holding power supply diode 93*c*, the second comparison transistor 93*a* is kept conductive, through the collector terminal of the latch transistor 93*b*; the driving auxiliary transistor 45*a* is driven to be conductive by way of the driving resistor 45*b*. An open-circuit stabilizing resistor 93*d* is connected between the base and emitter terminals of the latch transistor 93*b*; an open-circuit stabilizing resistor 45*c* is connected between the base and emitter terminals of the driving auxiliary transistor 45*a*, which is an NPN-type transistor.

Meanwhile, the driving transistor 46*a*, which supplies electric power from the vehicle battery 10 to the excitation coil 32B by way of the wiring terminal X, the power-source terminal B1, and the reverse connection protection device 47B, is a P-channel field-effect transistor; the driving transistor 46*a* is turned on by way of division resistors 46*b* and a reverse-current prevention diode 46*g* when the NPN-type driving auxiliary transistor 45*a* turns on. The division resistor 46*c* and the overvoltage protection diode 46*d* are connected between the source terminal of the driving transistor 46*a* and the gate terminal thereof. The reverse-current prevention diode 46*f* and the surge absorption diode 46*e* are connected between the gate terminal of the driving transistor 46*a* and the drain terminal thereof.

The reverse connection protection device 47B is a reversely connected P-channel field-effect transistor; the drain terminal thereof is connected with the power-source terminal B1, and the source terminal thereof is connected with the source terminal of the driving transistor 46*a*. The gate terminal of the transistor 47B, which works as a reverse connection protection device, is connected with driving auxiliary transistor 45*a* by way of a division resistor 47*d*; a division resistor 47*c* and an overvoltage protection diode 47*e* are connected between the source and gate terminals of the transistor 47B.

Accordingly, when the driving auxiliary transistor 45*a* is turned on, the transistor 47B is also turned on, whereby the voltage drop between the power-source terminal B1 and the driving transistor 46*a* becomes smaller than in the case of the diode 47A of Embodiment 1. In the case where the vehicle battery 10 is mistakenly connected with a reverse polarity, the reverse current can be prevented, as is the case with the diode 47A of Embodiment 1.

In the case where the vehicle battery 10 is connected with a wrong polarity, the reverse connection protection device 47B prevents the reverse energization circuit, which consists of the positive terminal of the vehicle battery 10, the ground terminal E1, the excitation coil 32B, and the parasitic diode in the driving transistor 46*a*, from becoming conductive, so that the reverse current is prevented from flowing from the power-source terminal B1 to the negative terminal of the vehicle battery 10, by way of the wiring terminal X.

In contrast, in the case where, when the mounting position of the starting control unit 20B is reversed, it is requested that the vehicle battery 10 is connected with the wiring terminal Y and the electromagnet shift relay 60 is connected with the wiring terminal X, the inter-terminal connection strip 33*b* is connected between the wiring terminal Y and the power-source terminal B2; therefore, the inter-terminal connection lead 49*b* is provided so that the vehicle battery 10 may be connected with either the power-source terminal B1 or the power-source terminal B2.

Figure 11:
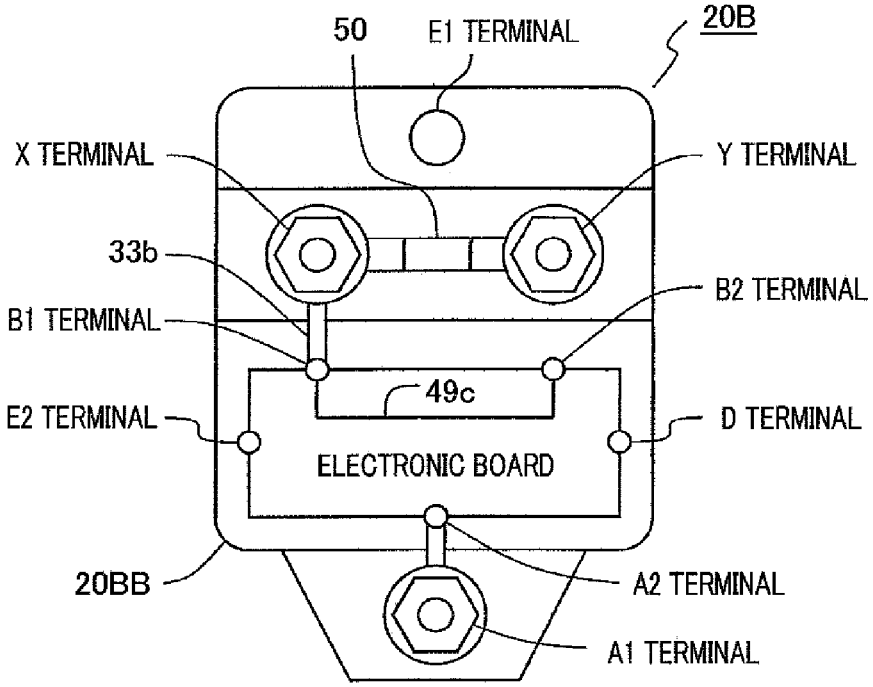
FIG. 11 is a view illustrating the top-surface configuration of a starting control unit according to Embodiment 3 of the present invention.
Figure 12:
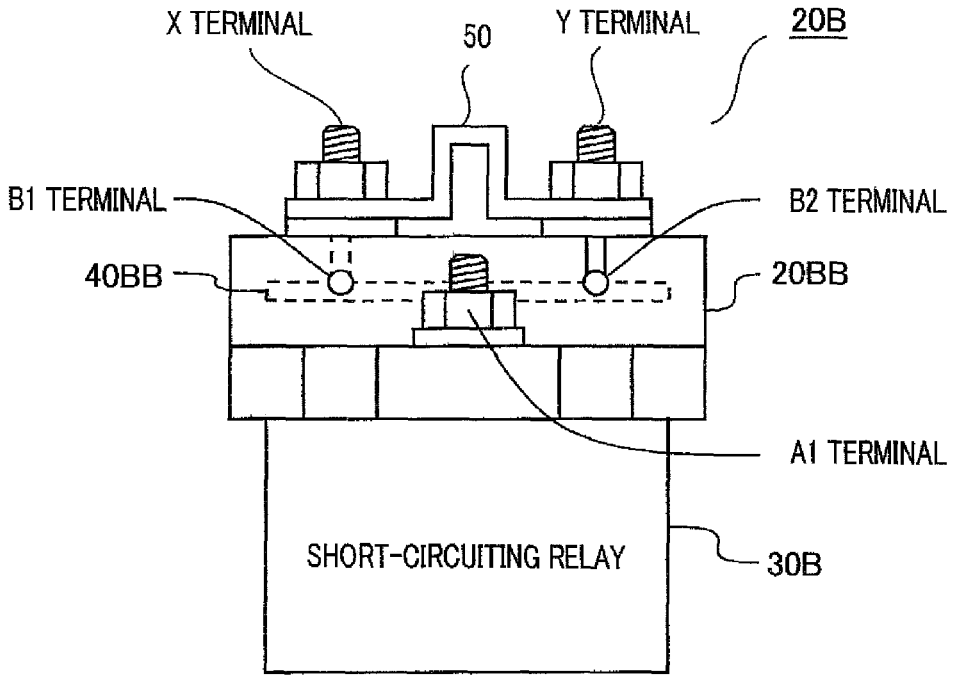
FIG. 12 is a diagram illustrating the side configuration of a starting control unit according to Embodiment 3 of the present invention.

Next, there will be explained FIGS. 11 and 12, which are the views of the top-surface configuration and the side configuration, respectively, of the starting control unit 20B according to Embodiment 3. In FIGS. 11 and 12, the starting control unit 20B is provided with the short-circuiting relay 30B mounted integrally with the bottom of a case 20BB; an electronic board 40BB that is situated inside the case 20BB and in which there are mounted circuit components included in the timer circuit 40B; the wiring terminals X and Y provided on the case 20BB; the command terminal A1; and the ground terminal E1.

On the electronic board 40BB, there are provided the command terminal A2, the power-source terminals B1 and B2, the driving terminal D, and the ground terminal E2; one of the wiring terminals X and Y and one of the power-source terminals B1 and B2 are connected with each other by the inter-terminal connection strip 33*b*. The command terminals A1 and A2 are connected with the ground terminals E1 and E2, respectively. The current suppression resistor 50 is fixed between the wiring terminals X and Y, by being screwed along with the wiring terminals X and Y; the resistance value of the current suppression resistor 50 is selectively determined in accordance with the typical characteristics of the starter motor 70 to be utilized. In the case where, in accordance with the arrangement relationship between the vehicle battery 10 and the starter motor 70, the mounting direction of the starting control unit 20B is changed so that the positions of the mounting pins thereof are changed, for example, by connecting the wiring terminal X always with the positive terminal of the vehicle battery 10 and supplying electric power to the power-source terminal B1 by way of the inter-terminal connection strip 33*b*, the power-source terminal B2 and the inter-terminal connection lead 49*b* can be removed.

Figure 13:
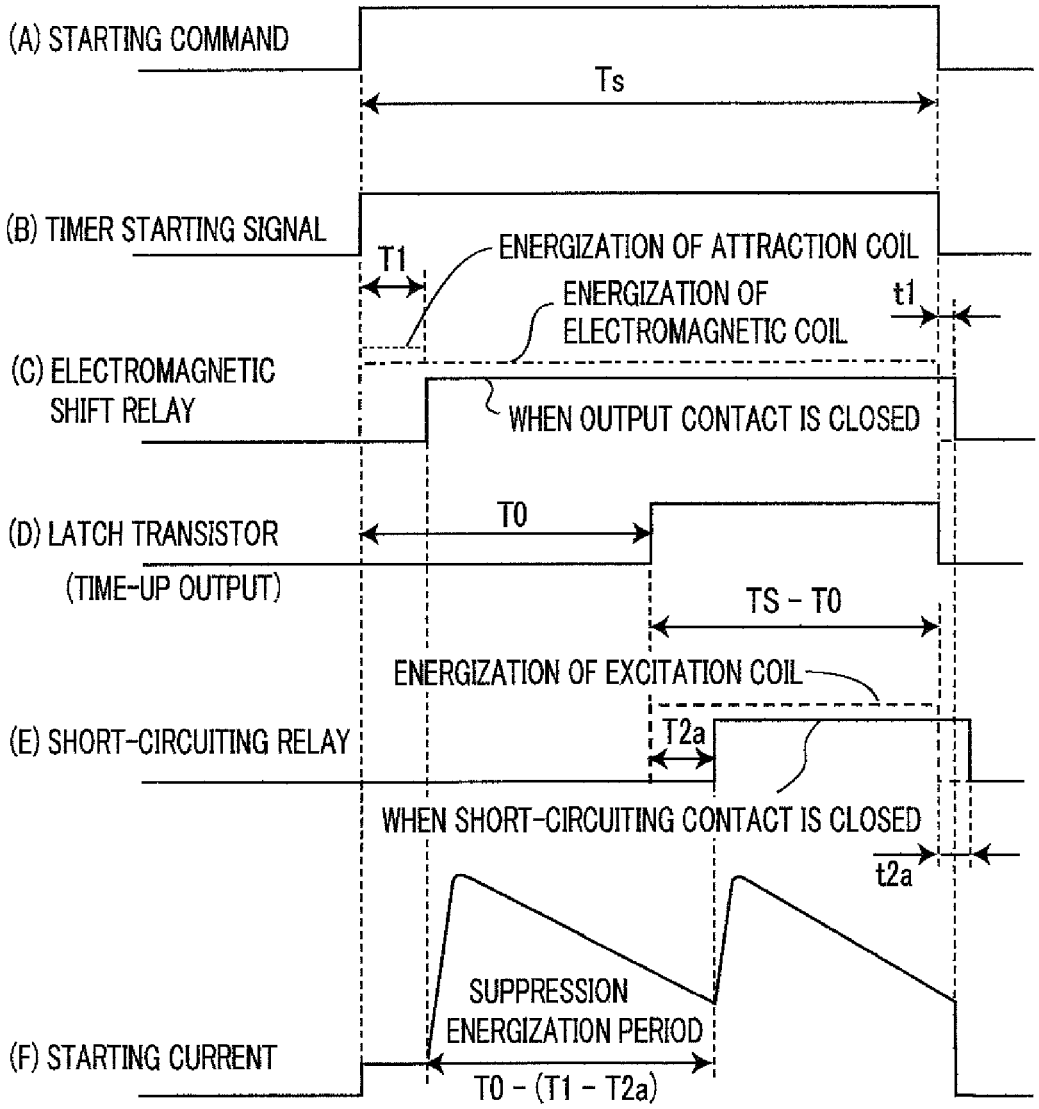
FIG. 13 is a timing chart for explaining the operation of a starting control unit according to Embodiment 3 of the present invention.

Next, the operation of the starting control unit 20B, configured in such a manner as described above, according to Embodiment 3 will be explained with reference to the timing chart in FIG. 13. The operation will be explained also with reference to FIGS. 9 and 10.

FIG. 13(A) represents the status of a command signal whose logic level becomes "H" during a circuit-closing command period Ts of the starting command switch 12. When the starting command switch 12 is closed, the attraction coil 62 and the holding coil 63 of the electromagnet shift relay 60 are energized, as illustrated in FIGS. 9 and 10, whereby the pinion gear provided on the starter motor 70 is pushed out in such a way as to engage with the ring gear of the engine, and after the closed-circuit response delay time T1 elapsed, the output contact 61 is closed.

FIG. 13(B) represents the logic level of a starting signal for indicating that the timer circuit 40B has started its timing operation immediately after the starting command switch 12 has been closed.

In FIG. 13(C), the dotted line denotes the energization period of the attraction coil 62 corresponding to the closed-circuit response delay time T1 of the electromagnet shift relay 60; the dashed line denotes the energization period of the holding coil 63 corresponding to the circuit-closing command period Ts; the solid line denotes the closed-circuit period of the output contact 61. When the starting command switch 12 is opened and hence the holding coil 63 is de-energized, the output contact 61 is opened when an open-circuit response time t1 of the electromagnet shift relay 60 has elapsed. When the output contact 61 is closed, the attraction coil 62 is short-circuited by a series circuit consisting of the current suppression resistor 50 and the output contact 61; however, because the resistance value of the current suppression resistor 50 is considerably smaller than the resistance value of the attraction coil 62, the attraction coil 62 is de-energized, whereby the holding coil 63 keeps the electromagnet shift relay 61 closed and the pinion gear pushed out.

FIG. 13(D) represents a state in which the latch transistor 93*b*, which becomes conductive at a time instant when a delay setting time T0 elapses after the starting command switch 12 has closed, is conductive. When the latch transistor 93*b* turns on, the driving auxiliary transistor 45*a* turns on and hence the driving transistor 46*a* is driven to be conductive.

In FIG. 13(E), the dotted line represents the energization period of the excitation coil 32B of the short-circuiting relay 30B; the excitation coil 32B is energized in a period from a time instant when the timer circuit 40B comes into the time-up state to a time instant when the starting command switch 12 is opened. When the excitation coil 32A is energized, the short-circuiting contact 31B, which is normally opened, is closed after a closed-circuit response time T2*a* of the short-circuiting relay 30B has elapsed; when the excitation coil 32B is de-energized, the short-circuiting contact 31B is closed again after an open-circuit response time t2*a* of the short-circuiting relay 30B has elapsed; the logic level "H" by a solid line represents a state in which the short-circuiting contact 31B is closed.

FIG. 13(F) represents the waveform of a starting current that flows in the starter motor 70; when the starting command switch 12 is closed, an energization current for the attraction coil 62 flows in the starter motor 70; when the output contact 61 is closed in due course of time, the starting current rapidly increases through the current suppression resistor 50, and as the rotation speed of the starter motor 70 rises, the starting current gradually decreases. When the short-circuiting contact 31B is closed, the starting current rapidly increases again, and as the rotation speed of the starter motor 70 further rises, the starting current gradually decreases.

When the starting command switch 12 is opened as the engine autonomously rotates, the output contact 61 is opened after the open-circuit response time t1 (refer to FIG. 13(C)) of the electromagnet shift relay 60 has elapsed, whereby the starting current is cut off. At a time immediately after the starting command switch 12 is opened, the output contact 61 is still closed; thus, an energization current flows from the attraction coil 62 to the holding coil 63 by way of the short-circuiting contact 31B and the output contact 61. In this case, the magnetic force by the attraction coil 62 and the magnetic force by the holding coil 63 works differentially; therefore, the electromagnet shift relay 60 is returned to be de-energized.

Provided another low-resistance load is driven through the starting command switch 12, the load is connected in parallel with the holding coil 63; therefore, the voltage applied to the attraction coil 62 increases, and the voltage applied to the holding coil 63 decreases, whereby there may occur an error in which the balance of the differential magnetic forces is broken and hence the electromagnetic shift relay 60 continues its operation holding state. However, in the case of Embodiment 3 illustrated in FIG. 9, only the high-resistance timer circuit 40B is connected in parallel with the holding coil 63 and the excitation coil 32B is not connected in parallel with the holding coil 63; therefore, the electromagnetic shift relay 60 is not erroneously opened.

What makes it possible is that the excitation coil 32B is directly connected with the vehicle battery 10 by way of the reverse connection protection device 47B and the driving transistor 46*a*; however, in the energization period Ts–T0 in FIG. 13(E), a current flows in the reverse connection protection device 47B and the driving transistor 46*a*, resulting in the temperature rise in the starting control unit 20B. As described above with reference to FIG. 10, it is effective to utilize a transistor, as the reverse connection protection device 47B, for suppressing this temperature rise.

When the short-circuiting contact 31B is closed in the energization period for the excitation coil 32B, no current flows in the current suppression resistor 50; thus, no temperature rise in the current suppression resistor 50 occurs. As a result, Embodiment 3 has an advantage of preventing the heat generated in the current suppression resistor 50 from being transferred to the timer circuit 40B and heating the timer circuit 40B.

Meanwhile, as represented in FIG. 13(F), the suppression energization period determined by the current suppression resistor 50 is obtained by subtracting the difference between a first closed-circuit response time T1, which is the closed-circuit response time of the electromagnetic shift relay 60, and a second closed-circuit response time T2*a*, which is the closed-circuit response time of the short-circuiting relay 30B, from the delay setting time T0. Among these periods, the delay setting time T0 is controlled in such a way as to be insusceptible to the fluctuation in the power-source voltage Vb and to be an approximately constant value; however, the first and second closed-circuit response times T1 and T2*a* fluctuate in inverse proportion to the supply voltage from the vehicle battery 10. However, because the fluctuation time, which is the difference time (T1−T2*a*), is added to the suppression energization period, the effect of the fluctuation time is reduced. For example, in the case where T1≈T2*a*, the suppression energization period should be insusceptible to the fluctuation in the power-source voltage; however, in fact, the value of the first closed-circuit response time T1 is slightly larger than the value of the second closed-circuit response time T2*a*; thus, the suppression energization period undergoes a reduced effect.

As is clear from the foregoing explanation, the starting control unit 20B according to Embodiment 3 is connected between the starter motor 70 that starts a vehicle engine and the vehicle battery 10, and performs current-limiting starting of the starter motor 70.

The starting control unit 20B integrally includes the current suppression resistor 50 connected in series with the output contact 61 of the electromagnetic shift relay 60 provided on the starter motor 70; the short-circuiting relay 30B that short-circuits the current suppression resistor 50 with the short-circuiting contact 31B thereof; and the timer circuit 40B that closes the short-circuiting contact 31B at a predetermined time instant when the starting current decreases in response to the operation of the starting command switch 12.

The electromagnetic shift relay 60 propels the pinion gear provided on the starter motor 70 through the shift coil 64 that is supplied with electric power from the vehicle battery 10 by way of the starting command switch 12 so that the ring gear provided on the crankshaft of the engine and the pinion gear engage with each other, and the electromagnetic shift relay 60 makes the output contact 61 close through the shift coil 64.

The short-circuiting contact 31B is a normally opened contact which is closed by energizing the excitation coil 32B of the short-circuiting relay 30B; the excitation coil 32B is supplied with electric power directly from the vehicle battery 10 by way of one of the terminals of the current suppression resistor 50, the reverse connection protection device 47B, and the driving transistor 46*a*, excluding the starting command switch 12.

The reverse connection protection device 47B is a transistor or a diode that enables power supply to the excitation coil 32B when the vehicle battery 10 is connected with a normal polarity, but prevents the power supply to the excitation coil 32B when the vehicle battery 10 is connected with an abnormal reversed polarity.

The timer circuit 40B is supplied with electric power from the vehicle battery 10 when the starting command switch 12 is closed, and turns on the driving transistor 46*a* after a predetermined delay setting time T0 has elapsed; the value of the delay setting time T0 is set in such a way as to be longer than the first closed-circuit response time T1 between the time instant when the electromagnetic shift relay 60 is energized and the time instant when the output contact 61 is closed.

Letting T0 denote the delay setting time of the timer circuit 40B, letting T1 denote the first closed-circuit response time between the time instant when the shift coil 64 for closing the output contact 61 or the electromagnetic shift relay 60 is energized and the time instant when the output contact 61 is closed, and letting T2*a* denote the second response delay time between the time instant when the short-circuiting relay 30B is energized and the time instant when the short-circuiting contact 31B is closed, a suppression starting current for the starter motor 70 flows in the current suppression resistor 50 in a time period given by the equation (T0+T2*a*−T1).

As described above, the starting control unit 20B according to Embodiment 3 is provided with the timer circuit 40B that connects the current suppression resistor 50 in series with the starter motor 70 in a predetermined period after the energization of the electromagnetic shift relay 60 that operates in response to the operation of the starting command switch 12 is started, and performs current-limiting starting; and the short-circuiting relay 30B, having a normally opened contact, that is energized and controlled by the timer circuit 40B. The short-circuiting relay 30B is supplied with electric power directly from the vehicle battery 10 by way of the reverse connection protection device 47B and the driving transistor 46*b*, excluding the starting command switch 12.

Accordingly, power-source wiring for the excitation coil 32B of the short-circuiting relay 30B is not required and the energization current for the short-circuiting relay 30B does not flow in the starting command switch 12; therefore, there is a characteristic that, by suppressing the current capacity of the switch, the small-size and inexpensive starting command switch 12 can be utilized.

In the case where the shift coil 64 of the electromagnetic shift relay 60 is a type that has the attraction coil 62 and the holding coil 63, the excitation coil 32B of the short-circuiting relay 30B is not connected in parallel with the shift coil 64; thus, when the starting command switch 12 is opened, the electromagnetic shift relay 60 does not erroneously operate; thus, there is a characteristic that circuit-opening operation can securely be implemented.

Because the closed-circuit response time T1, of the electromagnetic shift relay 60, that fluctuates depending on the power-source voltage and the closed-circuit response time T2*a* of the short-circuiting relay 30B reduce each other, the current suppression starting time hardly undergoes the effects of the closed-circuit response time T1 and the closed-circuit response time T2*a*, and the delay setting time T0 of the timer circuit 40B is determined, as the main time; thus, there is a characteristic that the effect of the fluctuation in the power-source voltage is reduced and hence a stabilized current suppression starting time can be obtained.

Even in the case where the power-source voltage of the vehicle battery 10 is low and hence the starting of the engine takes a long time, heating of the starting control unit 20B by the current suppression resistor 50 does not occur. Because the power-source voltage is low and hence the current in the excitation coil 32B of the short-circuiting relay 30B is relatively small, the heating of the starting control unit 20B is suppressed. Although, during the current-limiting starting period, the current suppression resistor 50 generates heat, the excitation coil 32B is not energized; thus, there is a characteristic that heat is prevented from concentrating so that overheating of the starting control unit 20B is suppressed.

Moreover, there is a characteristic that, even in the case where the connection of the vehicle battery 10 is implemented with an erroneous polarity, there can be prevented an accident where the short-circuiting relay 30B is continuously energized and hence burns out.

The timer circuit 40B compares the first comparison voltage V1 that is proportional to the driving power-source voltage V0 supplied from the vehicle battery 10 at a time when the starting command switch 12 is closed with the second comparison voltage V2 that is a gradually increasing charging voltage across the timer capacitor 44*b* charged from the common driving power-source voltage V0 by way of the charging resistor 44*a*; then, when both the first and second comparison voltages V1 and V2 coincide with each other after the predetermined delay setting time T0 has elapsed, the timer circuit 40A outputs the time-up output Tup so as to turn on the driving transistor 46*a*.

The power-source capacitor 41*b* and the constant voltage diode 48B, which prevent the driving power-source voltage V0 from abnormally decreasing when the power-source voltage Vb supplied from the vehicle battery 10 temporarily and rapidly decreases, stabilizes the driving power-source voltage V0 over the whole range of the fluctuation in the power-source voltage.

As described above, in the starting control unit 20B according to Embodiment 3, the timer circuit 40B is operated with the stabilized power source supplied from the vehicle battery 10.

Accordingly, there is a characteristic that, even when the power-source voltage of the vehicle battery 10 temporally decreases immediately after the output contact 61 of the electromagnetic shift relay 60 is closed, the timer circuit 40B does not erroneously operate. The use of the stabilized power source makes the power consumption in the timer circuit 40B increase when the power-source voltage is high; however, when the power-source voltage is high, the energization time for the short-circuiting relay 30B in the starting operation time of the starter motor 70 becomes short, compared with the short-circuiting relay having a normally closed contact; therefore, the power consumption in the reverse connection protection device 47B and the driving transistor 46*a* decreases, whereby there is a characteristic that heating is suppressed as a whole.

The timer circuit 40B further includes the latch transistor 93*b* that stores the state where the second comparison voltage V2 has become the same as or higher than the first comparison voltage V1; therefore, the conductive state of the driving transistor 46*a* for driving the short-circuiting relay 30B is kept by the latch transistor 93*b*.

Accordingly, there is a characteristic that, even when the short-circuiting contact 31B is closed and hence the power-source voltage rapidly decreases or even when the starting command switch 12 instantaneously turns off, the present state can be maintained once the current suppression resistor 50 is short-circuited. The same applies to the timer circuit 40A in Embodiment 1; in the case of the timer circuit 40A, the nonconductive state of the driving transistor 46*a* for driving the short-circuiting relay 30A is kept by the latch transistor 43*b*.

The transistor 47B, which is a reverse connection protection device, is a reversely connected P-channel field-effect transistor; the transistor 47B is reversely driven to be conductive when the excitation coil 32B is energized; in the case where the vehicle battery 10 is connected with a normal polarity, the driving current for the excitation coil 32B flows from the drain terminal of the transistor 47B to the source terminal thereof; in the case where the vehicle battery 10 is connected with an abnormal reversed polarity, the transistor 47B cuts off the current that intends to reversely flows from the excitation coil 32B by way of the internal parasitic diode of the driving transistor 46*a*.

As described above, in the starting control unit 20B according to Embodiment 3, the reverse connection protection device 47B is a P-channel field-effect transistor, which is reversely connected; the gate terminal voltage of the transistor 47B is controlled in conjunction with the operation of the driving auxiliary transistor 45*a* for performing energization drive of the driving transistor 46*a* for the short-circuiting relay 30B.

Accordingly, because the voltage drop at a time of a normal energization is small and hence heating is suppressed, and the driving voltage for the gate terminal is cut off when the driving transistor 46*a* is opened and hence the short-circuiting relay 30B is de-energized; thus, there is a characteristic that no normally discharging current from the vehicle battery 10 occurs. Even in the case of Embodiments 1 and 2, by utilizing a P-channel field-effect transistor, as the reverse connection protection device 47A, heat generated in the reverse connection protection device 47A can be suppressed. In the case of Embodiment 2 and Embodiment 4, described later, the same applies to the reverse connection protection device for the relay coil.

Embodiment 4

Figure 14:
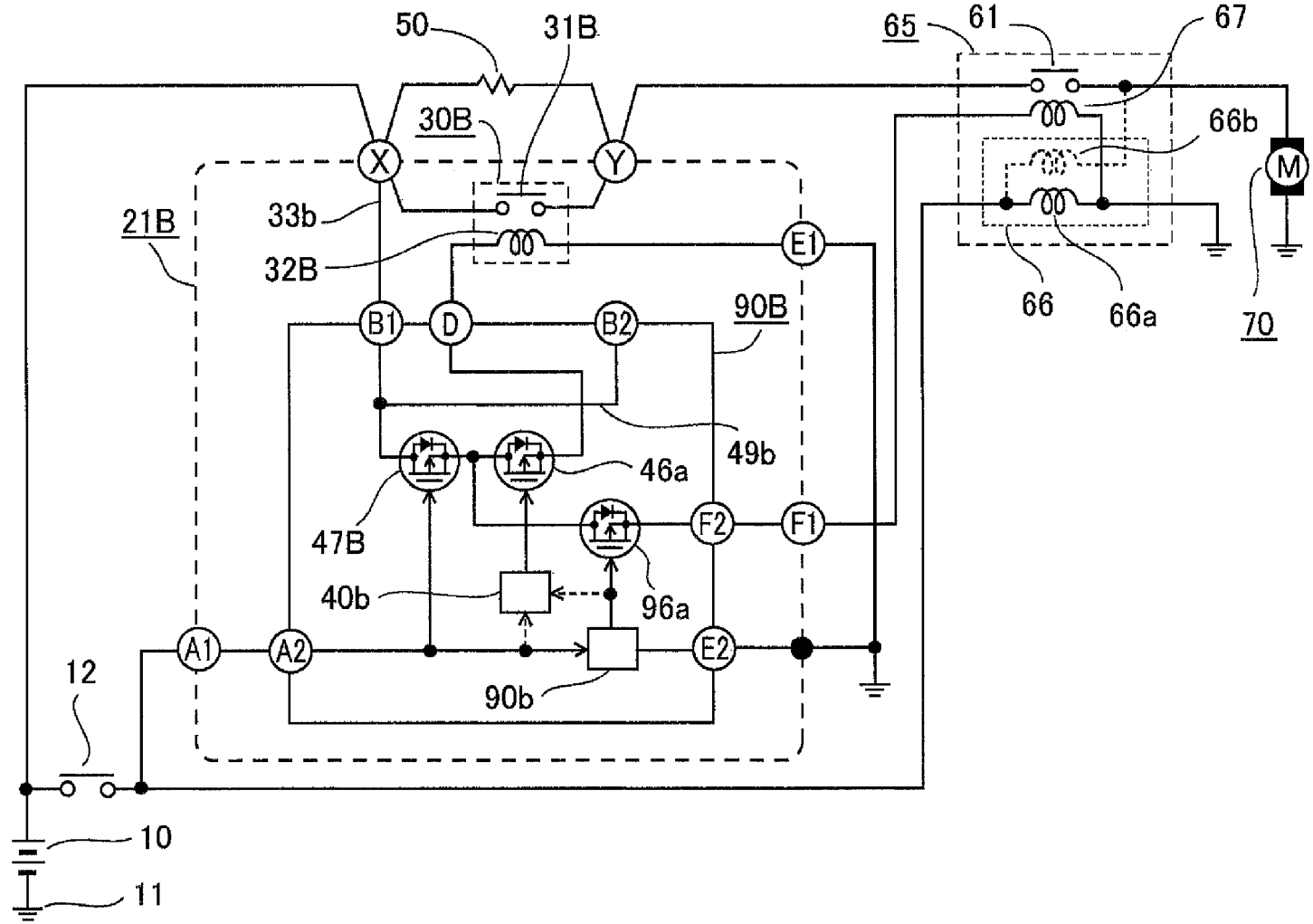
FIG. 14 is a diagram representing the connection between external devices and a starting control unit according to Embodiment 4 of the present invention.

Next, there will be explained a starting control unit according to Embodiment 4 of the present invention. FIG. 14 is a diagram representing the connection between external devices and a starting control unit according to Embodiment 4. Different points between Embodiments 3 and 4 will mainly be explained. In each of the drawings, the same reference characters denote the same or similar portions.

In FIG. 14, the negative terminal of the vehicle battery 10 is connected with the vehicle body 11; by way of the starting command switch 12, electric power is supplied to a starting control unit 21B from the positive terminal of the vehicle battery 11; the starting control unit 21B is mainly configured with the short-circuiting relay 30B and a timer circuit 90B; the current suppression resistor 50 is added on and integrated with the starting control unit 21B. The current suppression resistor 50 and an output contact 61 of an electromagnet shift relay 65 are connected in series with each other; they are connected between the positive terminal of the vehicle battery 10 and the starter motor 70.

Although omitted in FIG. 9, as is the case with Embodiment 1, in the starting command switch 12, the manual starting switch, which is a key switch, and the automatic starting switch for performing restarting after idling stop or remote warm-up operation in the cold season are connected in parallel with each other; electric power is supplied to the timer circuit 90B by way of the command terminals A1 and A2 and to a shift coil 66 of the electromagnet shift relay 65. In addition, as the starting command switch 12, there may be utilized an output contact 12 of a command electromagnet relay 105 in Embodiment 6 (refer to FIG. 17) described later.

The short-circuiting relay 30B is provided with a short-circuiting contact 31B, which is a normally opened contact; the short-circuiting contact 31B is closed by performing electric-power supply to and driving of an excitation coil 32B and is connected in parallel with the current suppression resistor 50 by way of the wiring the excitation coil 32B from the power-source terminals B1 and B2 of the timer circuit 90B; the power-source terminals B1 and B2 are connected with each other through the inter-terminal connection lead 49*b*; tg terminals X and Y. By way of the reverse connection protection device 47B, the driving transistor 46*a*, and the driving terminal D, electric power is supplied the wiring terminal X connected with the vehicle battery 10 and the power-source terminal B1 are connected with each other through the inter-terminal connection strip 33*b*.

The delayed timer circuit unit 90*b* generates an time-up output so as to drive and turn on a separately driving transistor 96*a* when a predetermined delay time Td elapses after the starting command switch 12 has closed, so that electric power is supplied to a relay coil 67 by way of the reverse connection protection device 47B, the separately driving transistor 96*a*, and driving terminals F2 and F1.

In contrast, the starting timer circuit unit 40*b* turns on the driving transistor 46*a* when a predetermined setting delay time T0 elapses after the delayed timer circuit unit 90*b* has come into the time-up state. The reverse connection protection device 47B is a reversely connected P-channel field-effect transistor; the drain terminal thereof is connected with the power-source terminal B1, and the source terminal thereof is connected with the driving transistor 46*a* and the source terminal of the separately driving transistor 96*a*. In this regard, however, the reverse connection protection devices 47B may be connected with the driving transistor 46*a* and the separately driving transistor 96*a* so that concentration of heat can be prevented.

The electromagnetic shift relay 65 is provided with the shift coil 66 that is supplied with electric power from the vehicle battery 10 by way of the starting command switch 12; when the shift coil 66 is supplied with electric power, the electromagnetic shift relay 65 propels the pinion gear provided on the starter motor 70 so that the ring gear provided on the crankshaft of the engine and the pinion gear engage with each other.

The shift coil 66 is formed of the first coil 66*a* that performs attraction operation and holding operation; however, the second coil 66*b* for assisting the attraction operation may concurrently be utilized. However, in the case where the second coil 66*b* is concurrently utilized, because the relay coil 67 is separately provided so as to close the output contact 61, the second coil 66*b* connected in series with the starter motor 70 is short-circuited to be de-energized when the relay coil 67 is energized so as to close the output contact 61.

In this type of the electromagnetic shift relay 65, the relay coil 67 for closing the output contact 61 and the shift coil 66 for pushing out the pinion gear are mechanically separated from each other; thus, the output contact 61 can be closed after the shift operation has securely been implemented. The delay time Td from a time instant when the shift coil 66 is energized to a time instant when the relay coil 67 is energize is set by the delayed timer circuit unit 90*b*; the value of the delay time Td is a fixed value corresponding to the maximum shift time at a time when the power-source voltage Vb of the vehicle battery 10 is low; in contrast, in the case where the power-source voltage Vb is high, there is implemented voltage correction for gradually shortening the delay time Td.

In the case where the delay time Td of the delayed timer circuit unit 90*b* is a constant value, it may be allowed that, by setting the setting time of the starting timer circuit unit 40*b* to T0+Td, the starting timer circuit unit 40*b* is supplied with electric power when the starting command switch 12 is closed; however, in the case where the operation time of the delayed timer circuit unit 90*b* is variably set by the power-source voltage Vb, by supplying electric power to the starting timer circuit unit 40*b* when the delayed timer circuit unit 90*b* comes into the time-up state, the stable delay setting time T0 can be obtained.

In the case where the shift coil 66 has the second coil 66*b* connected in series with the starter motor 70, when the relay coil 67 is supplied with electric power and hence the output contact 61 is closed, both terminals of the second coil 66*b* are short-circuited by the starting command switch 12 and the current suppression resistor 50 or the short-circuiting contact 31B, which is the output contact of the short-circuiting relay 30B. The resistance value of the current suppression resistor 50 is considerably smaller than the resistance value of the second coil 66*b*; therefore, the second coil 66*b* is de-energized, whereby the first coil 66*a* keeps the electromagnet shift relay 65 operative. However, when the starting command switch 12 is opened, the relay coil 67 is de-energized, and the output contact 61 is separately returned to be opened; then, both the first and second coils 66*a* and 66*b* are de-energized, so that the pinion gear is restored.

Next, the operation of the starting control unit 21B according to Embodiment 4 will be explained with reference to the timing chart in FIG. 15. The operation will be explained also with reference to FIG. 14.

FIG. 15(A) represents the status of a command signal whose logic level becomes "H" during a circuit-closing command period Ts of the starting command switch 12. When the starting command switch 12 is closed, the shift coil 66 of the electromagnet shift relay 65 is energized, as illustrated in FIG. 14, whereby the pinion gear provided on the starter motor 70 is pushed out in such a way as to engage with the ring gear of the engine.

FIG. 15(B) represents the energization period of the relay coil 67, of the electromagnetic shift relay 65, that is energized by the delayed timer circuit unit 90*b* after a delay time Td elapses; when the energization of the relay coil 67 starts, the starting timer circuit unit 40*b* starts its timing operation.

FIG. 15(C) represents the closed-circuit period of the output contact 61 that closes after the closed-circuit response delay time T1 of the electromagnetic shift relay 65 elapses. When the starting command switch 12 is opened and hence the relay coil 67 is de-energized, the output contact 61 is opened when an open-circuit response time t1 of the electromagnet shift relay 65 has elapsed.

FIG. 15(D) represents a state in which the latch transistor 93*b* (refer to FIG. 10), which becomes conductive at a time instant when a delay setting time T0 elapses after the relay coil 67 has been energized, is conductive. When the latch transistor 93*b* turns on, the driving auxiliary transistor 45*a* turns on and hence the driving transistor 46*a* is driven to be conductive.

In FIG. 15(E), the dotted line represents the energization period of the excitation coil 32B of the short-circuiting relay 30B; the excitation coil 32B is energized in a period from a time instant when the starting timer circuit unit 40*b* comes into the time-up state to a time instant when the starting command switch 12 is opened. When the excitation coil 32B is energized, the short-circuiting contact 31B, which is normally opened, is closed after a closed-circuit response time T2*a* of the short-circuiting relay 30B has elapsed; when the excitation coil 32B is de-energized, the short-circuiting contact 31B is closed again after an open-circuit response time t2*a* of the short-circuiting relay 30B has elapsed; the logic level "H" by a solid line represents a state in which the short-circuiting contact 31B is closed.

FIG. 15(F) represents the waveform of a starting current that flows in the starter motor 70; when the starting command switch 12 is closed and after the delay time Td and the closed-circuit response time T1 elapses, the output contact 61 is closed, the starting current rapidly increases through the current suppression resistor 50; then, the starting current gradually decreases as the rotation speed of the starter motor 70 rises. When the short-circuiting contact 31B is closed, the starting current rapidly increases again, and as the rotation speed of the starter motor 70 further rises, the starting current gradually decreases.

When the starting command switch 12 is opened as the engine autonomously rotates, the output contact 61 is opened after the open-circuit response time t1 (refer to FIG. 15(C)) of the electromagnet shift relay 65 has elapsed, whereby the starting current is cut off.

In the energization period Ts–T0–Td in FIG. 15(E), an excitation current for the excitation coil 32B flows in the reverse connection protection device 47B and the driving transistor 46*a*, resulting in the temperature rise in the starting control unit 21B. In suppressing the temperature rise, it is effective to utilize a transistor, as the reverse connection protection device 47B, as is the case with Embodiment 3 (refer to FIG. 10).

When the short-circuiting contact 31B is closed in the energization period for the excitation coil 32B, no current flows in the current suppression resistor 50; thus, no temperature rise in the current suppression resistor 50 occurs. As a result, Embodiment 3 has an advantage of preventing the heat generated in the current suppression resistor 50 from being transferred to the timer circuit 40B and heating the timer circuit 40B.

Meanwhile, as represented in FIG. 15(F), the suppression energization period determined by the current suppression resistor 50 is obtained by subtracting the difference between a first closed-circuit response time T1, which is the closed-circuit response time of the electromagnetic shift relay 65, and a second closed-circuit response time T2*a*, which is the closed-circuit response time of the short-circuiting relay 30B, from the delay setting time T0. Among these periods, the delay setting time T0 is controlled in such a way as to be insusceptible to the fluctuation in the power-source voltage Vb and to be an approximately constant value; however, the first and second closed-circuit response times T1 and T2*a* fluctuate in inverse proportion to the supply voltage from the vehicle battery 10. However, because the fluctuation time, which is the difference time (T1−T2*a*), is added to the suppression energization period, the effect of the fluctuation time is reduced.

In the case where the electromagnetic shift relay is a type that does not have the relay coil 67 for closing the output contact 61 and operates in conjunction with the pinion-gear pushing operation by the shift coil, T1 is longer than T2*a*; however, in the case where the electromagnetic shift relay has the relay coil 67, the relationship T1≈T2*a* is given; thus, the suppression energization period can be approximately insusceptible to the fluctuation in the power-source voltage.

As is clear from the foregoing explanation, the starting control unit 21B according to Embodiment 4 is connected between the starter motor 70 that starts a vehicle engine and the vehicle battery 10, and performs current-limiting starting of the starter motor 70.

The starting control unit 21B integrally includes the current suppression resistor 50 connected in series with the output contact 61 of the electromagnetic shift relay 65 provided on the starter motor 70; the short-circuiting relay 30B that short-circuits the current suppression resistor 50 with the short-circuiting contact 31B thereof; and the timer circuit 90B that closes the short-circuiting contact 31B at a predetermined time instant when the starting current decreases in response to the operation of the starting command switch 12.

The electromagnetic shift relay 65 propels the pinion gear provided on the starter motor 70 through the shift coil 66 that is supplied with electric power from the vehicle battery 10 by way of the starting command switch 12 so that the ring gear provided on the crankshaft of the engine and the pinion gear engage with each other, and the electromagnetic shift relay 65 makes the output contact 61 close through the relay coil 67 provided separately from the shift coil 66.

The short-circuiting contact 31B is a normally opened contact which is closed by energizing the excitation coil 32B of the short-circuiting relay 30B; the excitation coil 32B is supplied with electric power directly from the vehicle battery 10 by way of one of the terminals of the current suppression resistor 50, the reverse connection protection device 47B, and the driving transistor 46*a*, excluding the starting command switch 12.

The reverse connection protection device 47B is a transistor or a diode that enables power supply to the excitation coil 32B when the vehicle battery 10 is connected with a normal polarity, but prevents the power supply to the excitation coil 32B when the vehicle battery 10 is connected with an abnormal reversed polarity.

The timer circuit 90B starts its timing operation when the starting command switch 12 is closed and hence the relay coil 67 is supplied with electric power, and turns on the driving transistor 46*a* after a predetermined delay setting time T0 has elapsed; the value of the delay setting time T0 is set in such a way as to be longer than the first closed-circuit response time T1 between the time instant when the relay coil 67 is energized and the time instant when the output contact 61 is closed.

Letting T0 denote the delay setting time of the timer circuit 90B, letting T1 denote the first closed-circuit response time between the time instant when the relay coil 67 for closing the output contact 61 is energized and the time instant when the output contact 61 is closed, and letting T2*a* denote the second response delay time between the time instant when the short-circuiting relay 30B is energized and the time instant when the short-circuiting contact 31B is closed, a suppression starting current for the starter motor 70 flows in the current suppression resistor 50 in a time period given by the equation (T0+T2*a*−T1).

The electromagnetic shift relay 65 propels the pinion gear provided on the starter motor 70 through the shift coil 66 that is supplied with electric power from the vehicle battery 10 by way of the starting command switch 12 so that the ring gear provided on the crankshaft of the engine and the pinion gear engage with each other, and the electromagnetic shift relay 65 makes the output contact 61 close by separately driving the relay coil 67 provided separately from the shift coil 66.

The relay coil 67 is supplied with electric power to be driven when a predetermined delay time Td, which is set by the delayed timer circuit unit 90*b* provided in the timer circuit 90B, elapses after the shift coil 66 has been supplied with electric power; the value of the delay time Td is a fixed value corresponding to the maximum shift time at a time when the power-source voltage Vb of the vehicle battery 10 is low; in contrast, in the case where the power-source voltage Vb is high, there is implemented voltage correction for gradually shortening the delay time Td.

The short-circuiting contact 31B is a normally opened contact which is closed by energizing the excitation coil 32B of the short-circuiting relay 30B; the starting timer circuit unit 40*b* provided in the timer circuit 90B starts its timing operation when the relay coil 67 is energized.

The excitation coil 32B and the relay coil 67 are supplied with electric power directly from the vehicle battery 10 by way of one of the terminals of the current suppression resistor 50, the reverse connection protection device 47B, and the driving transistors 46*a* or the separately driving transistor 96*a*, excluding the starting command switch 12.

The reverse connection protection device 47B is a transistor or a diode that enables power supply to the excitation coil 32B and the relay coil 67 when the vehicle battery 10 is connected with a normal polarity, but prevents the power supply to the excitation coil 32B and the relay coil 67 when the vehicle battery 10 is connected with an abnormal reversed polarity.

The short-circuiting contact 31B is a normally opened contact which is closed by energizing the excitation coil 32B of the short-circuiting relay 30B.

The starting timer circuit unit 40*b* starts its timing operation when the relay coil 67 is energized, and comes into the time-up state after a predetermined delay setting time T0; alternatively, the starting timer circuit unit 40*b* starts its timing operation when the shift coil 66 is energized. The starting timer circuit unit 40*b* comes into the time-up state after the setting time obtained by adding the delay time Td and the delay setting time T0 has elapsed, and then energizes the excitation coil 32B.

As described above, in the starting control unit 21B according to Embodiment 4, the starting timer circuit unit 40*b* comes into the time-up state so as to energize the short-circuiting relay 30B, when the delay setting time T0 elapses after the relay coil 67 for divisionally driving the output contact 61 of the electromagnetic shift relay 65 has been energized.

Accordingly, there is eliminated the effect of the time required to shift the pinion gear whose operation time changes as the power-source voltage fluctuates; thus, because the current-limiting starting time in which a current flows in the current suppression resistor is given by the equation "the delay setting time T0−(the first closed-circuit response time T1 between the time instant when the relay coil of the electromagnetic shift relay is energized and the time instant when the output contact is closed)−(the second closed-circuit response time T2 between the time instant when the excitation coil of the short-circuiting relay is energized and the time instant when the short-circuiting contact is closed)", the first closed-circuit response time T1 and the second closed-circuit response time T2 reduce each other; therefore, there is a characteristic that even when the closed-circuit response changes as the power-source voltage fluctuates, its effect on the current-limiting starting time is reduced. In particular, because the pinion-gear shifting operation is separated by the shift coil, there is a characteristic that the closed-circuit response time of the output contact determined by the electromagnetic shift relay is approximately the same as the closed-circuit response time of the short-circuiting contact determined by the short-circuiting relay that deals with the same starting current.

Embodiment 5

In each of Embodiments 1 through 4, there has been explained a starting control unit, in which as the starting command switch, a manual starting switch and an automatic starting switch are connected in parallel with each other; however, it is also possible that as the starting command switch, a command electromagnet relay is utilized, and this command electromagnet relay is controlled by the output of a microprocessor. Hereinafter, as Embodiment 5, the configuration and the operation of the start command signal generation apparatus for a starting control unit will be explained in detail.

Figure 16:
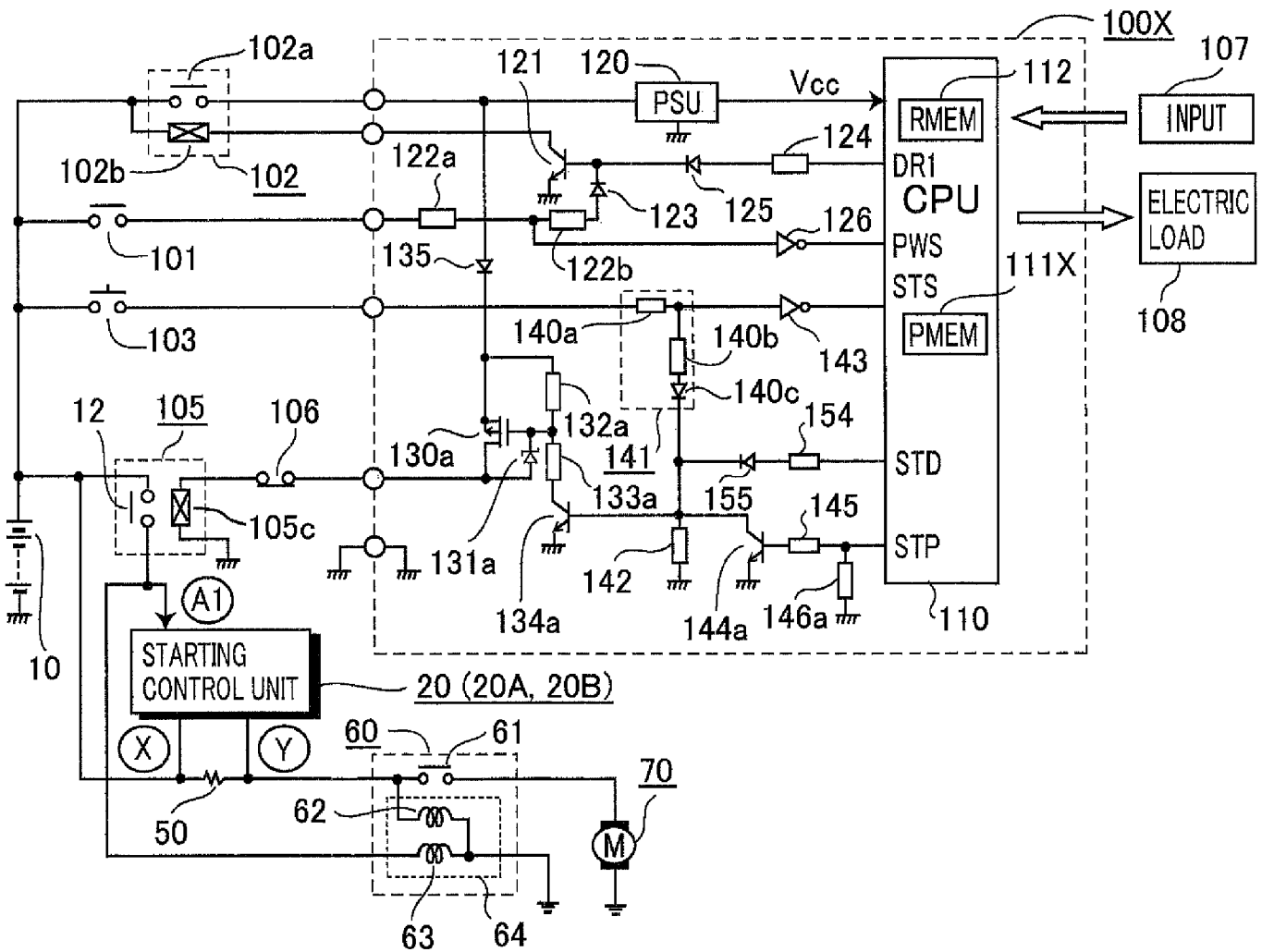
FIG. 16 is a diagram illustrating the circuit configuration of a start command signal generation apparatus according to Embodiment 5 of the present invention.

FIG. 16 is a diagram illustrating the overall circuit of a start command signal generation apparatus according to Embodiment 5 of the present invention. In FIG. 16, by way of an output contact 102*a* of a power supply relay 102, the vehicle battery 10 is connected with a start command signal generation apparatus 100X, which is an engine control apparatus; an excitation coil 102*b* of the power supply relay 102 is driven by a driving transistor 121, described later. A power switch 101 connected with the start command signal generation apparatus 100X is closed when an operation key is at any one of the first, second, and third pivotal positions; the manual starting switch 103 is closed when the operation key is at the third pivotal position.

By way of the output contact 61 of the electromagnetic shift relay 60 and a starting control unit 20 (corresponding to the starting control unit 20A of Embodiment 1 or the starting control unit 20B of Embodiment 3), the starter motor 70 is supplied with electric power from the vehicle battery 10 and, through an unillustrated electromagnetic push-out mechanism, engages with the ring gear of an engine so as to perform rotation drive of the engine. The shift coil 64 of the electromagnetic shift relay 60 is supplied with electric power and energized, by way of the output contact 12 of the command electromagnet relay 105.

The starting control unit 20 typifies the starting control unit 20A of Embodiment 1 or the starting control unit 20B of Embodiment 3. Each of various kinds of input sensors 107 is to input its sensor output to a microprocessor 110, described above, by way of an unillustrated interface circuit; the various kinds sensors include, for example, an air flow sensor for measuring the intake amount of an engine, an accelerator position sensor for detecting the accelerator pedal depression degree, a throttle position sensor for detecting the throttle opening degree, and engine crank angle sensor that monitor the commanding status for the engine and the engine operation status. Each of various kinds of electric loads 108 is supplied with electric power from the microprocessor 110, by way of an unillustrated interface circuit; for example, the various kinds of electric loads 108 include the driving electromagnetic coil for a fuel injection valve, an engine ignition coil (in the case where the type of the engine is a gasoline engine), the valve opening degree control motor for an air-intake throttle, the driving motor for an exhaust circulation valve, the electromagnetic clutch for an air conditioner, an alarm/display apparatus, and the like.

Inside the start command signal generation apparatus 100X, the microprocessor 110 is connected through a bus line, for example, with a program memory 111X, which is a nonvolatile flash memory, and a RAM memory 112 for calculation processing in such a way as to collaborate with them. In the program memory 111X, in addition to an input/output control program as an engine control apparatus, there are included a control program that serves as an automatic starting signal generation means for determining the necessity of an idling stop or determining the necessity of restarting after an idling stop so as to generate an automatic starting command signal STD and a control program that serves as a starting prohibition means for generating a starting prohibition command signal STP when an identification code provided in the key switch does not coincide with the inherent code data for identification.

The control power supply unit 120 is supplied with electric power through the output contact 102*a* of the power supply relay 102, generates a control voltage Vcc (=5 V) based on the power-source voltage of the vehicle battery 10, and supplies a stabilized voltage to the various units including the microprocessor 110.

The driving transistor 121 that drives the excitation coil 102*b* turns on by being supplied with its base current from the power switch 101 by way of driving resistors 122*a* and 122*b* and a diode 123, which are connected in series with one another, so as to close the output contact 102*a* of the power supply relay 102. When the output contact 102*a* is closed so as to supply electric power to the control power supply unit 120 and hence the microprocessor 110 starts its operation, the base current of the driving transistor 121 is supplied by way of a self-holding driving resistor 124 and a diode 125, based on a self-holding driving command DR1 generated by the microprocessor 110; after that, even when the power switch 101 is opened, the power supply relay 102 continues its energization operation; then, when the microprocessor 110 stops the self-holding driving command DR1, the power supply relay 102 is de-energized.

The NOT logic device 126 generates a power switch on/off state monitoring signal PWS whose logic level becomes "L"/"H" in accordance with High/Low of the electric potential at the connection point between the driving resistors 122*a* and 122*b*, i.e., in accordance with ON/OFF of the power switch 101, and inputs the power switch on/off state monitoring signal PWS to the microprocessor 110.

A serial opening/closing device 130*a* that is supplied with electric power through the output contact 102*a* of the power supply relay 102 by way of a reverse connection protection device 135 is connected with an excitation coil 105*c* of the command electromagnet relay 105 by way of an interlock switch 106. The interlock switch 106 is closed when the selection position of the gearbox is either at the parking position or at the neutral position.

A surge absorption diode 131*a* is connected between the drain and gate terminals of the serial opening/closing device 130*a*, which is a P-channel field-effect transistor; a division resistor 132*a* is connected between the source and gate terminals of the serial opening/closing device 130*a*. The gate terminal of the serial opening/closing device 130*a* is connected with the ground by way of a conduction driving resistor 133*a* and a conduction driving transistor 134*a*. The conduction driving transistor 134*a* turns on by being supplied with its base current from the manual starting switch 103 by way of starting resistors 140*a* and 140*b* and a diode 140*c*, which are connected in series with one another, so as to energize the command electromagnet relay 105 by way of the serial opening/closing device 130*a*. A direct starting circuit 141 configured with the starting resistors 140*a* and 140*b* and the diode 140*c* makes it possible that even when the microprocessor 110 is inoperative, the serial opening/closing device 130*a* is turned on through the manual starting switch 103 by way of the conduction driving transistor 134*a*.

A stabilization resistor 142 is connected between the base and emitter terminals of the conduction driving transistor 134*a*, which is an NPN-type transistor. The NOT logic device 143 generates a starting command monitoring signal STS whose logic level becomes "L"/"H" in accordance with High/Low of the electric potential at the connection point between the direct starting resistor 140*a* and 140*b*, i.e., in accordance with ON/OFF of the manual starting switch 103, and inputs the starting command monitoring signal STS to the microprocessor 110.

A prohibition transistor 144*a* connected between the base and emitter terminals of the conduction driving transistor 134*a* is driven by a conduction prohibition command output STP generated by the microprocessor 110, by way of the base resistor 145; in the case where the identification code has any discrepancy or when the engine is autonomously rotating, the prohibition transistor 144*a* turns on and hence the conduction driving transistor 134*a* turns off, so that the command electromagnet relay 105 is de-energized.

When the microprocessor 110 is inoperative, the prohibition transistor 144*a* turns off, because of a pull-down resistor 146*a*.

In the case where, for example, the reception circuit of an unillustrated remote starting apparatus is connected in series with the microprocessor 110 and the microprocessor receives an engine starting command from the reception circuit, or when automatic starting driving is implemented after an idling stop, an output signal of the logic level "H" is generated, as the automatic starting command signal STD, so that the base current of the conduction driving transistor 134*a* is supplied by way of a driving resistor 154 and a diode 155. As a result, the serial opening/closing device 130*a* turns on and hence the command electromagnet relay 105 is energized, so that rotation drive of the starter motor 70 is implemented.

Even in the case where the output voltage of the vehicle battery 10 in the over-discharge state abnormally decreases due to the starting current of the starter motor 70 and hence the microprocessor 110 of the start command signal generation apparatus 100X becomes inoperative, the conduction driving transistor 134*a* turns on by being supplied with its base current from the manual starting switch 103 by way of the direct starting resistor 140*a* and 140*b* and the diode 140*c*, which are connected in series with one another, so as to energize the command electromagnet relay 105 by way of the serial opening/closing device 130*a*.

After the starting current decreases as the rotation speed of the engine rises and the microprocessor 110 starts its operation, in the case where the identification code has discrepancy, the starting prohibition command signal STP is generated so as to prohibit the starting of the engine, and in the case where the engine has already started its autonomous rotation, fuel injection and ignition control are stopped, so that the engine is stopped.

When the vehicle battery 10 is in the over-discharge state, the idling-stop driving and the remote-starting driving are regarded as ineffective, and the command electromagnet relay 105 is operated through the automatic starting command signal STD based on the controlling operation by the microprocessor 110; the engine starting commands can be unified to the output contact 12 of the command electromagnet relay 105. Accordingly, the driving currents for the electromagnetic shift relay 60 in which a relatively large current flows can be concentrated at the starting command switch 12, which is the output contact of the command electromagnet relay 105.

Even in the case where the operation response time of the command electromagnet relay 105 fluctuates due to the effect of the power-source voltage, this fluctuation does not provide any effect on the current-limiting starting control time, because energization of the electromagnetic shift relay 60 and issue of the command to the timer circuit in the starting control unit 20 are started at the same time when the output contact 12 is closed.

In the foregoing explanation, the start command signal generation apparatus 100X drives the command electromagnet relay 105 by way of the serial opening/closing device 130*a* so as to close the starting command switch 12, which is the output contact of the command electromagnet relay 105; however, it may be also possible that by utilizing the serial opening/closing device 130*a* having a larger rated current, as the starting command switch 12, the command electromagnet relay 105 is removed.

It may be also possible that by relocating the interlock switch 106 from the location in FIG. 16 to the downstream side of the direct starting circuit 141, the method of starting of the engine, after an idling stop, through the automatic starting command signal STD is changed to the method in which even when the transmission is at the drive position, the engine can be started when the brake pedal is restored.

As is clear from the foregoing explanation, the start command signal generation apparatus 100X according to Embodiment 5 corresponds to the starting control unit 20; the starting command switch 12 is either the serial opening/closing device 130*a* that functions as a command opening/closing device that responds to the control output of the start command signal generation apparatus 100X including at least the fuel injection control function or the output contact of the command electromagnet relay 105 that is energized and controlled by the serial opening/closing device 130*a*; the start command signal generation apparatus 100X is provided with the microprocessor 110 to which, as input signals, there are inputted a mode switch signal for determining at least whether or not idling-stop driving should be implemented or whether or not remote staring through a wireless electric wave should be implemented, a plurality of input sensors 107 for determining the engine stopping condition for performing idling stop and for determining the remote starting condition or the restarting condition after idling stop, and the manual starting switch 103; and the serial opening/closing device 130*a* that serves as a command opening/closing device.

Each of the engine stopping condition, the remote starting condition, and the restarting condition includes at least the condition that the power-source voltage of the vehicle battery 10 is the same as or higher than a predetermined value; when engine starting after an idling stop or remote starting is implemented, the microprocessor 110 generates the automatic starting command signal STD so as to turn on the serial opening/closing device 130*a*; the serial opening/closing device 130*a* is provided with the direct starting circuit 141 that keeps the serial opening/closing device 130*a* turned on as long as the manual starting switch 103 is closed, even in the case where the microprocessor 110 is inoperative due to an abnormal voltage drop of the vehicle battery 10.

As described above, in the start command signal generation apparatus 100X according to Embodiment 5, a plurality of starting commands, which includes commands for engine direct starting through manual operation, engine starting after an idling stop based on the automatic starting command signal STD of the microprocessor 110 or automatic starting through remote starting, are concentrated at the output contact of the command electromagnet relay 105 or at the serial opening/closing device 130*a* that functions as the command opening/closing device, so that the output contact of the command electromagnet relay 105 or the serial opening/closing device 130*a* are utilized as the starting command switch; thus, the engine starting through manual operation is effective, even when the microprocessor 110 is inoperative.

Therefore, there is a characteristic that even in the case where there occurs a situation in which although the microprocessor 110 generates the automatic starting command signal STD, the power-source voltage of the vehicle battery 10 temporarily decreases in an abnormal manner, due to the starting current that flows in the starter motor 70, and hence the battery capacity decreases to such an extent that the microprocessor 110 becomes inoperative, that the automatic starting command signal STD is cancelled, and that the starter motor 70 stops its operation, the starter motor 70 can be kept operative, by keeping the manual starting switch 103 pushed through manual operation.

In the case where the starter motor 70 is kept operative through manual operation and the vehicle battery 10 has a capacity for supplying electric power required to make the engine autonomously rotate, the rotation speed of the starter motor 70 rises; then, because the starting current decreases as the rotation speed of the starter motor 70 rises, the power-source voltage is restored and the microprocessor 110 starts its operation, so that the engine can autonomously rotate.

There is a characteristic that in driving the electromagnetic shift relay 60, the starting command switches in each of which a relatively large current flows can be represented by the command electromagnet relay 105 or the serial opening/closing device 130*a*.

Furthermore, there is a characteristic that even when the closed-circuit response delay time of the command electromagnet relay 105 fluctuates depending on the power-source voltage, the fluctuation does not provide any effect on the current suppression starting time.

In order to prevent erroneous restarting of the engine in the rotation mode or in the case where the identification number provided in the manual starting switch 103 has a discrepancy, the microprocessor 110 generates the starting prohibition command signal STP for prohibiting the engine from being started. When the starting prohibition command signal STP is generated, the starting prohibition transistor 144*a* is turned on; after the starting prohibition transistor 144*a* has been turned on, the serial opening/closing device 130*a* is prohibited from being turned on. When the starting prohibition command signal STP is not generated or when the microprocessor 110 is inoperative, the prohibition transistor 144*a* is turned off through a pull-down resistor 146*a*.

As described above, in the start command signal generation apparatus 100X according to Embodiment 5, when the microprocessor 110 generates the starting prohibition command signal STP, the starting prohibition transistor 144*a* turns on so that the serial opening/closing device 130*a* that drives the command electromagnet relay 105 is prohibited from turning on; however, while the microprocessor 110 does not generate the starting prohibition command signal STP or when the microprocessor 110 is inoperative, the starting prohibition transistor 144*a* becomes nonconductive, and in the case where the manual starting switch 103 is closed, the serial opening/closing device 130*a* turns on, so that the command electromagnet relay 105 operates.

Therefore, there is a characteristic that even in the case where, due to the starting current that flows in the starter motor 70, the power-source voltage of the vehicle battery 10 temporarily decreases in an abnormal manner and hence the microprocessor 110 becomes inoperative, the engine can be started through the manual starting switch 103, and when the power-source voltage is restored as the starting current decreases with the rise of the engine rotation speed and hence the microprocessor 110 starts its operation, inappropriate starting of the engine can be prevented.

Embodiment 6

Figure 17:
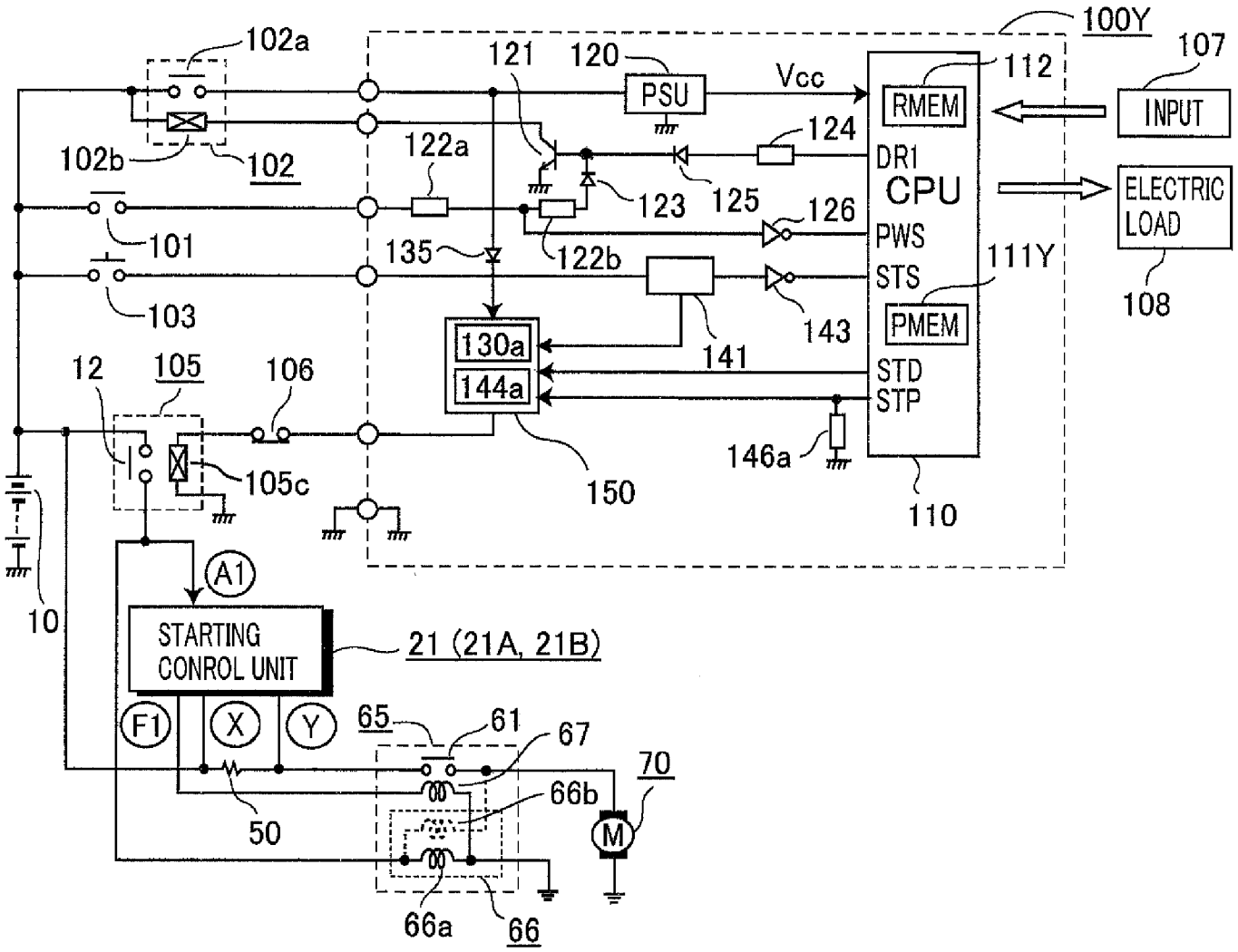
FIG. 17 is a diagram illustrating the circuit configuration of a start command signal generation apparatus according to Embodiment 6 of the present invention.

Next, there will be explained a start command signal generation apparatus according to Embodiment 6 of the present invention. FIG. 17 is a diagram illustrating the overall circuit of a start command signal generation apparatus according to Embodiment 6. The configuration and the operation of Embodiment 6 will be explained mainly in terms of different points between Embodiments 5 and 6. In each of the drawings, the same reference characters denote the same or similar portions.

In FIG. 17, a start command signal generation apparatus 100Y, which is an engine control apparatus, is configured mainly with microprocessor 110 that collaborates with a program memory 111Y; the start command signal generation apparatus 100Y is provided with a serial opening/closing circuit 150 including a series of circuits from the serial opening/closing device 130*a* (refer to FIG. 16) to the starting prohibition transistor 144*a* (refer to FIG. 16) of the start command signal generation apparatus 100X according to Embodiment 5. The serial opening/closing circuit 150 is supplied with electric power from the output contact 102*a* of the power supply relay 102 by way of the reverse connection protection device 135; in response to a command signal from the direct starting circuit 141, the automatic starting command signal STD, and a command signal based on the starting prohibition command signal STP, the serial opening/closing circuit 150 performs energization control of the command coil 105*c* of the command electromagnet relay 105.

As is the case with Embodiment 5, the start command signal generation apparatus 100Y is connected with the power switch 101, the power supply relay 102, the manual starting switch 103, the command electromagnet relay 105, a group of input sensors 107, and a group of electric loads 108. However, by way of the output contact 61 of the electromagnetic shift relay 65 and a starting control unit 21 (corresponding to the starting control unit 21A of Embodiment 2 or the starting control unit 21B of Embodiment 4), the starter motor 70 is supplied with electric power from the vehicle battery 10 and, through an unillustrated electromagnetic push-out mechanism, engages with the ring gear of an engine so as to perform rotation drive of the engine. The shift coil 66 of the electromagnetic shift relay 65 is supplied with electric power and energized, by way of the output contact 12 of the command electromagnet relay 105.

The starting control unit 21 typifies the starting control unit 20A of Embodiment 2 or the starting control unit 21B of Embodiment 4; when the delay time Td elapses after the starting command switch 12 has closed, a driving signal for the relay coil 67 is generated from a driving terminal F1. Accordingly, in comparison with Embodiment 5, the starting control unit 20 and the electromagnetic shift relay 60 of Embodiment 5 are replaced by the starting control unit 21 and the electromagnetic shift relay 65, respectively; as is the case with the start command signal generation apparatus 100X, the start command signal generation apparatus 100Y needs only to generate the starting command signal through the output contact 12 of the command electromagnet relay 105.

Accordingly, as is the case with the start command signal generation apparatus 100X according to Embodiment 5, there is a characteristic that in driving the electromagnetic shift relay 65, the starting command switches in each of which a relatively large current flows can be represented by the command electromagnet relay 105.

Moreover, there is a characteristic that even when the closed-circuit response delay time of the command electromagnet relay 105 fluctuates depending on the power-source voltage, the fluctuation does not provide any effect on the current suppression starting time.

Still moreover, even in the case where, due to the starting current that flows in the starter motor 70, the power-source voltage of the vehicle battery 10 temporarily decreases in an abnormal manner and hence the microprocessor 110 becomes inoperative, the engine can be started through the manual starting switch 103, and when the power-source voltage is restored as the starting current decreases with the rise of the engine rotation speed and hence the microprocessor 110 starts its operation, inappropriate starting of the engine can be prevented.

The delayed timer circuit unit that performs delayed power supply to the separately provided command coil 105*c* is formed of hardware in the starting control unit 21; therefore, there is a characteristic that even when the power-source voltage of the vehicle battery 10 abnormally decreases, delayed drive of the command coil 105*c* can be performed.

Embodiment 7

Figure 18:
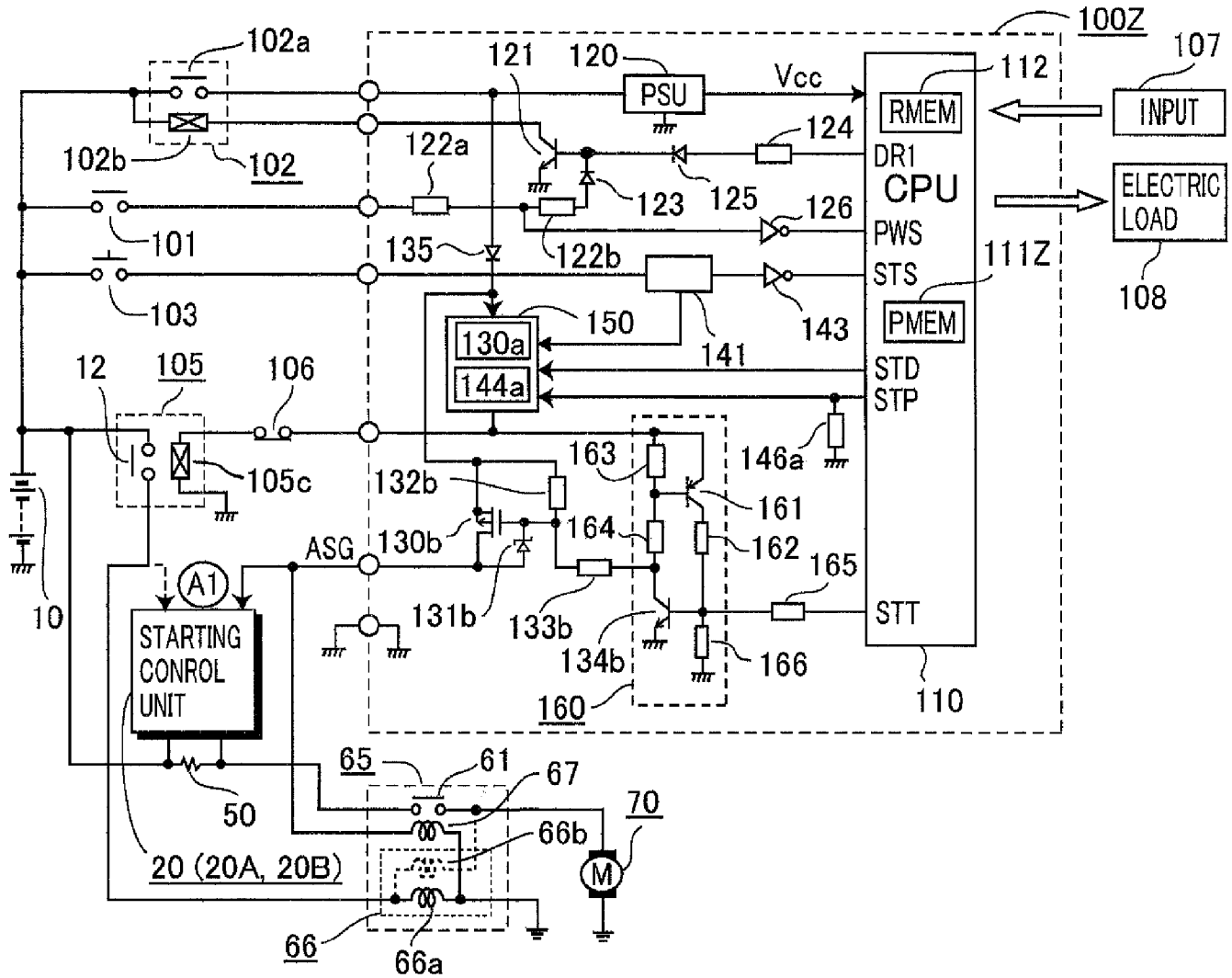
FIG. 18 is a diagram illustrating the circuit configuration of a start command signal generation apparatus according to Embodiment 7 of the present invention.

Next, there will be explained a start command signal generation apparatus according to Embodiment 7 of the present invention. FIG. 18 is a diagram illustrating the overall circuit of a start command signal generation apparatus according to Embodiment 7. The configuration and the operation of Embodiment 7 will be explained mainly in terms of different points between Embodiments 5 and 7. In each of the drawings, the same reference characters denote the same or similar portions.

In FIG. 18, a start command signal generation apparatus 100Z, which is an engine control apparatus, is configured mainly with microprocessor 110 that collaborates with a program memory 111Z; the start command signal generation apparatus 100Y is provided with a serial opening/closing circuit 150 including a series of circuits from the serial opening/closing device 130*a* (refer to FIG. 16) to the starting prohibition transistor 144*a* (refer to FIG. 16) of the start command signal generation apparatus 100X according to Embodiment 5. The serial opening/closing circuit 150 is supplied with electric power from the output contact 102*a* of the power supply relay 102 by way of the reverse connection protection device 135; in response to a command signal from the direct starting circuit 141, the automatic starting command signal STD, and a command signal based on the starting prohibition command signal STP, the serial opening/closing circuit 150 performs energization control of the command coil 105*c* of the command electromagnet relay 105.

As is the case with Embodiment 5 (refer to FIG. 16), the start command signal generation apparatus 100Z is connected with the power switch 101, the power supply relay 102, the manual starting switch 103, the command electromagnet relay 105, a group of input sensors 107, and a group of electric loads 108. However, by way of the output contact 61 of the electromagnetic shift relay 65 and a starting control unit 20 (corresponding to the starting control unit 20A or the starting control unit 20B), the starter motor 70 is supplied with electric power from the vehicle battery 10 and, through an unillustrated electromagnetic push-out mechanism, engages with the ring gear of an engine so as to perform rotation drive of the engine. In this regard, however, the shift coil 66 of the electromagnetic shift relay 65 is supplied with electric power and energized, by way of the output contact 12 of the command electromagnet relay 105.

The starting control unit 20 typifies the starting control unit 20A of Embodiment 1 or the starting control unit 21B of Embodiment 3; however, the starting control unit 20 does not generate the drive signal for the relay coil 67 of the electromagnetic shift relay 65. Instead of the drive signal, in the start command signal generation apparatus 100Z, the microprocessor 110 generates a delayed energization permission signal STT and a series of circuits from an energization permission storage circuit 160, described later, to a serial opening/closing device 130*b* generates an auxiliary command signal ASG so that the relay coil 67 is energized.

The serial opening/closing device 130*b* that is supplied with electric power through the output contact 102*a* of the power supply relay 102 by way of the reverse connection protection device 135 is connected with the relay coil 67 and the command terminal A1 of the starting control unit 20. A surge absorption diode 131*b* is connected between the drain and gate terminals of the serial opening/closing device 130*b*, which is a P-channel field-effect transistor; a division resistor 132*b* is connected between the source and gate terminals of the serial opening/closing device 130*b*. The gate terminal of the serial opening/closing device 130*b* is connected with the ground by way of a conduction driving resistor 133*b* and a conduction driving transistor 134*b*.

In the energization permission storage circuit 160, the base terminal and the collector terminal of a PNP-type storage transistor 161 are connected with the collector terminal and the base terminal of an NPN-type conduction driving transistor 134*b* by way of base resistors 164 and 162, respectively; an open-circuit stabilizing resistors 163 is connected between the base and emitter terminals of the PNP-type storage transistor 161, and an open-circuit stabilizing resistors 166 is connected between the base and emitter terminals of the NPN-type conduction driving transistor 134*b*.

Next, there will be explained the detail of the starting control of the starter motor 70 in which the start command signal generation apparatus 100Z and the starting control unit 20 according to Embodiment 7 are utilized.

In FIG. 18, when the power switch 101 is closed, the driving transistor 121 is turned on; the excitation coil 102*b* of the power supply relay 102 is energized; the output contact 102*a* is closed; then, the start command signal generation apparatus 100Z is supplied with electric power. As a result, the control power supply unit 120 is supplied with electric power through the output contact 102*a* of the power supply relay 102, generates a control voltage Vcc (=5 V) based on the power-source voltage of the vehicle battery 10, and supplies a stabilized voltage to the various units including the microprocessor 110.

When the microprocessor 110 starts its operation, the base current of the driving transistor 121 is supplied based on the self-holding driving command DR1 generated by the microprocessor 110. After that, even when the power switch 101 is opened, the power supply relay 102 continues its energization operation; then, when the microprocessor 110 stops the self-holding driving command DR1, the power supply relay 102 is de-energized.

Then, when the manual starting switch 103 is closed, the serial opening/closing device 130*a* in the serial opening/closing circuit 150 is turned on through the direct starting circuit 141 and hence the excitation coil 105*c* of the command electromagnet relay 105 is energized by way of the interlock switch 106; thus, because the starting command switch 12, which is the output contact of the command electromagnet relay 105, is closed, the shift coil 66 of the electromagnetic shift relay 65 is supplied with electric power and hence the pinion gear is pushed out. When a delay time Td elapses after the manual starting switch 103 has been closed, the microprocessor 110 generates the delayed energization permission signal STT; then, the auxiliary command signal ASG is outputted by way of the energization permission storage circuit 160 and the serial opening/closing device 130*b*. As a result, the relay coil 67 is energized, and the command terminal A1 of the starting control unit 20 is supplied with electric power.

After that, the starting control unit 20 performs current-limiting starting by use of the current suppression resistor 50; even in the case where, due to the starting current that flows in the starter motor 70, the power-source voltage Vb of the vehicle battery 10 decreases in an abnormal manner and the microprocessor 110 temporarily becomes inoperative, whereby the delayed energization permission signal STT is temporarily stopped, energization of the relay coil 167 is continued through the storage operation by the energization permission storage circuit 160; because the manual starting switch 103 has been opened, electric power supply to the shift coil 66 and the relay coil 67 is cut off, and information stored in the energization permission storage circuit 160 is deleted.

In the energization permission storage circuit 160, when the conduction driving transistor 134*b* is turned on by the delayed energization permission signal STT, the base current of the storage transistor 161 flows through the base resistor 164 and the conduction driving transistor 134, whereby the storage transistor 161 is turned on; as a result, because being driven by way of the base resistor 162, the conduction driving transistor 134*b* turns on; thus, even when the delayed energization permission signal STT disappears, the conduction driving transistor 134*b* is kept conductive, and when the serial opening/closing device 130*a* provided in the power-supply circuit for the energization permission storage circuit 160 is opened, this storage state is cancelled.

The same applies to the case where instead of the operation by the manual starting switch 103, for example, the microprocessor 110 generates the automatic starting command signal STD in restarting after an idling stop; at first, electric power is supplied to the shift coil 66 by way of the command electromagnet relay 105; then, after the delay time Td elapses, the relay coil 67 is energized and the starting control unit 20 starts the current-limiting starting. However, in the case where, while the engine is started through the automatic starting command signal STD, the microprocessor 110 becomes inoperative due to the abnormal drop in the power-source voltage Vb, starting control is stopped; thus, originally, restriction is made in such a way that when the vehicle battery 10 is in the over-discharge state, neither idling-stop driving nor remote-starting driving can be performed.

In the case of double-starting of the rotating engine, or in the case where the identification code provided in the key switch has a discrepancy, the microprocessor 110 generates neither the automatic starting command signal STD nor the delayed energization permission signal STT; even when the manual starting switch 103 is closed, the microprocessor 110 generates the starting prohibition command signal STP so as to turn off the serial opening/closing device 130*a*. The pull-down resistor 146*a* is provided for the purpose of preventing the starting prohibition command signal STP from being erroneously generated in the case where after normal starting has begun through the manual starting switch 103, the microprocessor 110 becomes temporarily inoperative due to an abnormal drop in the power-source voltage Vb of the vehicle battery 10.

Even in the case where as the starting control unit, the starting control unit 20B according to Embodiment 3 is utilized and the timer circuit 40B should start its timing operation at a time when the relay coil 67 is energized, the timer circuit 40B can start its timing operation at a time the shift coil 66 is energized, by extending the setting delay time T0 to T0+Td in the case where the delay time Td of the delayed energization permission signal STT is a predetermined fixed value.

In the case where as the starting control unit, the starting control unit 20A according to Embodiment 1 is utilized and the timer circuit 40A should start its timing operation at a time when the output contact 61 is closed, the same applies; the start command signal generation apparatus 100Z may be configured also in such a way that the shift coil 66 is energized through the starting command switch 12, which is the output contact of the command electromagnet relay 105, and at the same time, the control power source is supplied to the command terminal A1 of the starting control unit 20.

Moreover, the start command signal generation apparatus 100Z may be configured also in such a way that instead of directly driving the relay coil 67 through the auxiliary command signal ASG, an auxiliary relay is inserted to energize the relay coil 67 so that the rated current of the serial opening/closing device 130*b* is reduced and a power transistor module in which a plurality of transistors are integrated is utilized.

In the foregoing explanation, the start command signal generation apparatus 100Z drives the command electromagnet relay 105 by way of the serial opening/closing device 130*a* so as to close the starting command switch 12, which is the output contact of the command electromagnet relay 105; however, it may be also possible that by utilizing the serial opening/closing device 130*a* having a larger rated current, as the starting command switch 12, the command electromagnet relay 105 is removed. In this case, it may be also possible that the energizing current for the shift coil 66 is controlled by controlling the opening/closing duty rate of the serial opening/closing device 130*a*.

As is clear from the foregoing explanation, in the start command signal generation apparatus 100X according to Embodiment 7, the electromagnetic shift relay 65 has the shift coil 66 and the relay coil 67 that are provided in such a way as to be separated from each other, and the starting control unit 20 has no delayed power supply output for the relay coil 67.

The start command signal generation apparatus 100Z is provided with the serial opening/closing circuit 150 that includes the serial opening/closing device 130*a* for directly driving the shift coil 66 of the electromagnetic shift relay 65 or indirectly driving the shift coil 66 by way of the output contact of the command electromagnet relay 105; the energization permission storage circuit 160 that performs energization drive of the serial opening/closing device 130*b* for driving the relay coil 67 of the electromagnetic shift relay 65; the microprocessor 110 that generates the automatic starting command signal STD and the delayed energization permission signal STT; and the direct starting circuit 141.

When engine starting after an idling stop or remote starting is implemented, the microprocessor 110 generates the automatic starting command signal STD so as to turn on the serial opening/closing circuit 150 and to supply electric power to the shift coil 66 of the electromagnetic shift relay 65; when the closed-circuit signal from the manual starting switch 103 is inputted or when the automatic starting command signal STD is generated, the microprocessor 110 generates the delayed energization permission signal STT after a predetermined delay time Td has elapsed.

The direct starting circuit 141 keeps the serial opening/closing circuit 150 turned on as long as the manual starting switch 103 is closed, even in the case where the microprocessor 110 is inoperative due to an abnormal voltage drop of the vehicle battery 10; the energization permission storage circuit 160 stores the fact that the delayed energization permission signal STT has been generated, and generates the auxiliary command signal ASG by way of the serial opening/closing device 130*b* for energizing the relay coil 67.

Even when the microprocessor 110 becomes inoperative, there is maintained the state in which the delayed energization permission signal STT is stored; however, at a time when the manual starting switch 103 is opened and the automatic starting command signal STD disappears, the storage is cancelled; the value of the delay time Td is a fixed value corresponding to the maximum shift time at a time when the power-source voltage Vb of the vehicle battery 10 is low; in contrast, in the case where the power-source voltage Vb is high, there is implemented voltage correction for gradually shortening the delay time Td.

As described above, in the start command signal generation apparatus 100Z according to Embodiment 7, a plurality of starting commands, which includes commands for engine direct starting through manual operation, engine starting after an idling stop based on the automatic starting command signal STD of the microprocessor 110 or automatic starting through remote starting, are concentrated at the output contact of the command electromagnet relay 105 or at the command opening/closing device, so that the output contact of the command electromagnet relay 105 or the command opening/closing device are utilized as the starting command switch 12 for the shift coil 66 of the electromagnetic shift relay 65. In addition, after the predetermined delay time Td has elapsed, the auxiliary command signal ASG for energizing the relay coil 67 is generated.

Accordingly, the electromagnetic shift relay 65 is collectively controlled by the start command signal generation apparatus 100Z, and the relay coil 67 is energized when a predetermined time elapses after the shift coil 66 has been energized; thus, there is a characteristic that the pinion gear can securely be pushed out.

There is a characteristic that even in the case where due to an excessive starting current, the power-source voltage abnormally drops and hence the microprocessor 110 becomes inoperative in the starting process, the energization permission storage circuit 160 keeps the relay coil 67 operative as long as the manual starting switch 103 is closed, and when the microprocessor 110 starts its operation as the rotation speed of the engine rises, the starting operation can be continued.

The starting control unit 20 that receives a command from the start command signal generation apparatus 100Z is provided with the short-circuiting contact 31B (refer to FIG. 10), which is a normally opened contact that is closed when the excitation coil 32B (refer to FIG. 10) of the short-circuiting relay 30B for short-circuiting the current suppression resistor 50 is energized; the drive signal for the relay coil 67 that is generated by the start command signal generation apparatus 100Z is utilized as the timing operation starting signal for the timer circuit 40B (refer to FIG. 10) provided in the starting control unit 20.

As described above, the timer circuit 40B in the starting control unit 20 starts its timing operation in response to a relay coil drive signal generated by the start command signal generation apparatus 100Z; the starting control unit 20 is provided with short-circuiting relay 30B having a normally opened contact.

Accordingly, there is eliminated the effect of the time required to shift the pinion gear whose operation time changes as the power-source voltage fluctuates; thus, because the current-limiting starting time in which a current flows in the current suppression resistor 50 is given by the equation "the delay setting time T0−(the first closed-circuit response time T1 between the time instant when the relay coil 67 of the electromagnetic shift relay 65 is energized and the time instant when the output contact 61 is closed)−(the second closed-circuit response time T2 between the time instant when the excitation coil 32B of the short-circuiting relay 30B is energized and the time instant when the short-circuiting contact 31B is closed)", the first closed-circuit response time T1 and the second closed-circuit response time T2 reduce each other; therefore, there is a characteristic that even when the closed-circuit response changes as the power-source voltage fluctuates, its effect on the current-limiting starting time is reduced. In particular, because the pinion-gear shifting operation is separated by the shift coil, there is a characteristic that the closed-circuit response time of the output contact 61 determined by the electromagnetic shift relay 65 is approximately the same as the closed-circuit response time of the short-circuiting contact 31B determined by the short-circuiting relay 30B that deals with the same starting current.

Various modifications and alterations of this invention will be apparent to those skilled in the art without departing from the scope and spirit of this invention, and it should be understood that this is not limited to the illustrative embodiments set forth herein.

What is claimed is:

1. A starting control unit that is connected between a starter motor for starting a vehicle engine and a vehicle battery and performs current-limiting starting of the starter motor, the starting control unit integrally comprising:

a current suppression resistor connected in series with an output contact of an electromagnetic shift relay provided on the starter motor;

a short-circuiting relay that short-circuits the current suppression resistor with a short-circuiting contact thereof; and a timer circuit that closes the short-circuiting contact at a predetermined time instant when a starting current decreases in response to the operation of a starting command switch, wherein the electromagnetic shift relay propels a pinion gear provided on the starter motor, through a shift coil that is supplied with electric power from the vehicle battery by way of the starting command switch, so that a ring gear provided on the crankshaft of an engine and the pinion gear engage with each other; and the electromagnetic shift relay makes the output contact close through the shift coil or a relay coil provided separately from the shift coil, wherein the short-circuiting contact is a normally closed contact which is opened by energizing an excitation coil of the short-circuiting relay; and the excitation coil is supplied with electric power directly from the vehicle battery by way of one of the terminals of the current suppression resistor, a reverse connection protection device, and a driving transistor, excluding the starting command switch, wherein the reverse connection protection device is a transistor or a diode that enables power supply to the excitation coil when the vehicle battery is connected with a normal polarity, but prevents the power supply to the excitation coil when the vehicle battery is connected with an abnormal reversed polarity, wherein the driving transistor is turned on so as to perform open-circuit energization of the short-circuiting relay at the same time when the starting command switch is closed and hence the shift coil or the relay coil is energized; and by the time the output contact is closed, the short-circuiting contact completes its circuit-opening operation, wherein the timer circuit starts timing operation in response to closing operation by the output contact of the electromagnetic shift relay, and turns off the driving transistor after a predetermined delay setting time elapses, and wherein a suppression starting current for the starter motor flows in the current suppression resistor during a time period obtained by adding the delay setting time of the timer circuit and a closed-circuit response time from a time instant when the excitation coil of the short-circuiting relay is de-energized to a time instant when the short-circuiting contact is returned to be closed.

2. The starting control unit according to claim 1, wherein the timer circuit detects a voltage drop generated across the current suppression resistor at a time when the output contact is closed, and then starts its timing operation.

3. The starting control unit according to claim 1, wherein the timer circuit compares a first comparison voltage that is proportional to a driving power-source voltage supplied from the vehicle battery in response to closing operation by the starting command switch with a second comparison voltage that is a gradually increasing charging voltage across a timer capacitor charged from the common driving power-source voltage by way of a charging resistor at a time when the output contact is closed; and when both the first and second comparison voltages coincide with each other after a predetermined delay setting time has elapsed, the timer circuit outputs the time-up output so as to turn off the driving transistor.

4. The starting control unit according to claim 3, wherein a power-supply resistor and a voltage limiting diode are connected with a driving power-source circuit for the timer circuit; and the voltage limiting diode is a constant voltage diode having an operation voltage with which a voltage limiting function works in the high-voltage range within the fluctuation range of the driving power-source voltage but does not work in the low-voltage range.

5. The starting control unit according to claim 3, wherein the timer circuit further includes a latch transistor that stores a state where the second comparison voltage has become the same as or higher than the first comparison voltage.

6. The starting control unit according to claim 1, wherein the current suppression resistor is integrated with the starting control unit by being mounted and fixed on the outer wall of a case containing the starting control unit.

7. The starting control unit according to claim 6, wherein the parallel circuit consisting of the short-circuiting contact, which is the output contact of the short-circuiting relay, and the current suppression resistor is connected between the vehicle battery and the output contact of the electromagnetic shift relay connected with the starter motor; one of a pair of wiring terminals of the parallel circuit is connected with the vehicle battery; the timer circuit is provided with a pair of power-source terminals that are internally connected with each other through an inter-terminal connection lead; when one of the pair of wiring terminals is connected with the vehicle battery, the one of the pair of wiring terminals is connected with one of the power-source terminals; and when the other one of the pair of wiring terminals is connected with the vehicle battery, the other one of the pair of wiring terminals is connected with the other one of the power-source terminals.

* * * * *